US006004713A

United States Patent [19]

Urata et al.

[11] Patent Number: 6,004,713

[45] Date of Patent: Dec. 21, 1999

[54] TONER, DEVELOPER, AND PROCESS FOR PRODUCING THE SAME

[75] Inventors: Yoshinori Urata, Kashihara; Hitoshi Nagahama, Uji; Yasuharu Morinishi, Tenri; Satoshi Ogawa, Yamatokoriyama; Toshihisa Ishida, Kashiba; Tadashi Nakamura; Takahiro Bito, both of Nara, all of Japan

[73] Assignee: Sharp Kabushiki Kaisha, Osaka, Japan

[21] Appl. No.: 09/048,398

[22] Filed: Mar. 26, 1998

[30] Foreign Application Priority Data

Apr. 15, 1997 [JP] Japan ..... 9-097391
Apr. 15, 1997 [JP] Japan ..... 9-097397

[51] Int. Cl.[6] ..... G03G 9/00

[52] U.S. Cl. ..... 430/110

[58] Field of Search ..... 430/110, 137

[56] References Cited

U.S. PATENT DOCUMENTS

| | | | |
|---|---|---|---|
| 5,176,978 | 1/1993 | Kumashiro et al. | 430/110 |
| 5,225,301 | 7/1993 | Yushina et al. | 430/137 |
| 5,858,596 | 1/1999 | Tajima et al. | 430/137 |

FOREIGN PATENT DOCUMENTS

| | | |
|---|---|---|
| 195 34 384 A1 | 4/1996 | Germany . |
| 2-161468 | 6/1990 | Japan . |
| 6-194878 | 7/1994 | Japan . |
| 7-152205 | 6/1995 | Japan . |
| 8-76518 | 3/1996 | Japan . |

*Primary Examiner*—John Goodrow
*Attorney, Agent, or Firm*—David G. Conlin; George W. Neuner

[57] ABSTRACT

A process for preparing a toner includes forming a melt-kneaded mixture by mixing a raw material mixture containing a quaternary ammonium salt compound at a temperature ranging from (M−7)° C. to (M+7)° C., where M is a melting point of the quaternary ammonium salt compound, with a kneading device having a discharge port whose temperature is set lower than a temperature at which a melt viscosity of the melt-kneaded mixture at the discharge port is not higher than 10,000 Pa.a, removing the melt-kneaded mixture from the kneading device, rolling out the melt-kneaded mixture to a thickness ranging from 1.2 mm to 3.0 mm, and cooling down the melt-kneaded mixture. With the use of the toner produced by this process, the amount of charge during copying is retained in an appropriate range irrespectively of the working atmosphere and conditions of use, thereby maintaining a good image density.

16 Claims, 4 Drawing Sheets

TONER, DEVELOPER, AND PROCESS FOR PRODUCING THE SAME

FIELD OF THE INVENTION

The present invention relates to toners and developers for use in an electrophotographic apparatus (image forming apparatus) such as a copying machine and laser beam printer employing an electrophotographic printing method, and to a process for producing toners.

BACKGROUND OF THE INVENTION

In an electrophotographic apparatus employing the electrophotographic printing method, the developer is caused to adhere temporarily onto the surf ace of an image carrier, for example, a photoreceptor, on which an electrostatic latent image is formed in the developing step, transferred to a transfer sheet (copy sheet) from the image carrier in the transfer step, and then fixed to the transfer sheet in the fixing step.

As the developer for forming a copied image (toner image) by developing the electrostatic latent image, two-component developer composed of toner and carrier, and one-component developer (such as magnetic toner and non-magnetic toner) requiring no carrier have been known.

Examples of the toner contained in the developer are positively charged toner and negatively charged toner. As additives for imparting a predetermined charging property to the positively charged toner, for example, charge control agents such as nigrosine compounds (dyes) and quaternary ammonium salt compounds are known. A known example of the additives for imparting a predetermined charging property to the carrier is a coating additive. Among these additives, the quaternary ammonium salt compounds are substantially colorless and can provide toners having a relatively large amount of charge.

Therefore, the quaternary ammonium salt compounds can be used not only for black toner, but also for color toner. Hence, in recent years, there is increasing demand for the quaternary ammonium salt compounds. For example, Japanese publication of unexamined patent application No. 76518/1996 (Tokukaihei 8-76518) discloses a toner to which a quaternary ammonium salt compound is added.

In general, a toner is produced as follows. First, raw materials including additives such as a binder resin, colorant, and charge control agent are mixed evenly. After melt-kneading the mixture, the mixture is ground and classified to provide the toner. External additives may be added to the toner, if necessary.

However, the above-mentioned conventional toner, i.e., toner containing the quaternary ammonium salt compound, can not retain an appropriate amount of charge, for example, when the electrophotographic apparatus is used continuously or when the toner is stored inside the electrophotographic apparatus for a long time. More specifically, for instance, when the electrophotographic apparatus is used continuously, the amount of charge tends to increase with an increase in the number of copies produced, and a lowering of the image density is a likely result.

Moreover, there is a significant difference in the charging property (charging characteristic) of toner between a normal atmosphere (for example, at a temperature of 25° C. and relative humidity of 60%) and a high-temperature high-humidity atmosphere (for example, at a temperature of 35° C. and relative humidity of 85%). Namely, the charging property of the toner is easily affected by the working atmosphere.

Thus, it is hard to say that the above-mentioned conventional toner can fully exhibit the effect (charge imparting effect) produced by the addition of the quaternary ammonium salt compound. In other words, since the conventional toner cannot retain an appropriate amount of charge irrespectively of the working atmosphere, the image density cannot be maintained in an appropriate level.

In addition, when transporting the toner, for example, in the case of domestic transport, the toner is sometimes kept loaded on the bed of a track parked for a long time under the blazing sun. In the case of transport to abroad, the toner is sometimes kept loaded in the non-air-conditioned cargo of a ship for a long time.

Like the above cases, if the conventional toner, i.e., the toner containing the quaternary ammonium salt compound, is left under the atmosphere of high temperatures exceeding, for example, 40° C. for a long tine, the toner cannot retain an appropriate amount of charge.

Therefore, when such a toner left under the high-temperature atmosphere is used, a phenomenon (fog) in which the white portion of a transfer sheet to which a copied image is transferred overlaps the copied image occurs due to the vicious effect on the toner. As a result, the charging property (charging characteristic) is lowered, and the image quality is extremely degraded.

In the case when the copying machine (electrophotographic apparatus) is used continuously, the inside of the copying machine is made dirty by the toner. There is also a possibility that the atmosphere of the office and the like in which the copying machine is installed is worsened by the continuous use of the copying machine.

However, it is practically impossible to avoid a situation where the toner is left under the atmosphere of high temperatures exceeding, for example 40° C. for a long time during transport of the toner. Hence, the charging property of the toner is easily affected by, for example, the transporting atmosphere.

It is thus hard to say that the above-mentioned conventional toner can fully exhibit the effect (charge imparting effect) produced by the addition of the quaternary ammonium salt compound. In other wards, since the conventional toner cannot retain an appropriate amount of charge irrespectively of the transporting atmosphere, the image density cannot be maintained at appropriate level.

Similarly, when the developer is left under the atmosphere of high temperatures exceeding, for example 40° C. for a long time, the amount of charge decreases, causing a lowering of the image density. Namely, when the amount of charge of the developer decreases, the developer is not sufficiently supplied to the surface of the image carrier in the development step (copying). Consequently, the image density is lowered.

In such circumstances, there is demand for toner, developer and the process of producing toner, capable of overcoming the above-mentioned drawbacks.

SUMMARY OF THE INVENTION

It is an object of the present invention to provide a process for producing a toner capable of fully exhibiting the effect produced by the addition of a quaternary ammonium salt compound. In other words, the object of the present invention is to provide a process for producing a toner capable of retaining an appropriate amount of charge during copying irrespectively of the working atmosphere and conditions of use, and maintaining a good image density. It is also the object of the present invention to provide toner and developer capable of exhibiting the effect produced by the addition of the quaternary ammonium salt compound, i.e., retaining an appropriate amount of charge during copying and maintaining a good image density even after being left under the high temperature atmosphere for a long time.

The present inventor studied toner, developer and the process for producing toner. As a result, it was discovered that, in order to produce a toner capable of exhibiting the effect produced by the addition of the quaternary ammonium salt compound, it is important to control conditions, such as the temperature in melt-kneading a raw material mixture, within a specific range according to the melting point of the quaternary ammonium salt compound.

Specifically, the amount of charge during copying can be maintained in an appropriate range irrespectively of the working atmosphere by melt-kneading a raw material mixture containing a quaternary ammonium salt compound at a temperature ranging from (M−7)° C. to (M+7)° C. where M is the melting point of the quaternary ammonium salt compound, with a kneading device having a discharge port whose temperature has been set so that the melt viscosity of the melt-kneaded mixture at the discharge port is not more than 10,000 Pa.s, removing the melt-kneaded mixture from the kneading device, rolling out the melt-kneaded mixture to a thickness between 1.2 mm and 3.0 mm, and cooling down the melt-kneaded mixture.

Hence, the present inventor found the process of producing a toner capable of maintaining a good image density, and completed the invention.

Namely, in order to achieve the above object, a process for producing a toner of the present invention includes: melt-kneading a raw material mixture containing a quaternary ammonium salt compound at a temperature ranging from (M−7)° C. to (M+7)° C. where M is the melting point of the quaternary ammonium salt compound, with a kneading device having a discharge port whose temperature has been set so that the melt viscosity of the melt-kneaded mixture at the discharge port is not more than 10,000 Pa.s; removing the melt-kneaded mixture from the kneading device; rolling out the melt-kneaded mixture to a thickness between 1.2 mm and 3.0 mm; and cooling down the melt-kneaded mixture.

According to this process, the amount of charge during copying can be retained in an appropriate range irrespectively of the working atmosphere and conditions of use, thereby providing a toner capable of maintaining a good image density, i.e., toner capable of improving the image quality. Moreover, the use of the toner can improve the charging stability and image stability during copying, and prevent the image carrier such as a photoreceptor from being made dirty (filmed with the toner).

Besides, a toner of the present invention is produced by the above-mentioned process, and satisfies inequality (I)

$$(B/A)<0.2 \quad \text{(I)}$$

where A is the peak area of the thermal analysis absorption peak of a quaternary ammonium salt compound per unit weight of a raw material mixture, and B is the peak area of the thermal analysis absorption peak of the quaternary ammonium salt compound per unit weight of the toner produced from the raw material mixture, under the same conditions.

This toner can retain an appropriate amount of charge during copying irrespectively of the working atmosphere and conditions of use, thereby maintaining a good image density. Namely, the toner can improve the image quality. With the use of the toner, it is possible to improve the charging stability and image stability during copying, and prevent the image carrier such as the photoreceptor from being made dirty (filmed with the toner).

Furthermore, the present inventor studied toners and developers, and found the cause of lowering the charging property of a toner when the toner is left under a high-temperature atmosphere for a long time. Namely, the exposed quaternary ammonium salt compound at the surface of toner is prevented from performing its function as a charge control agent.

In order to exhibit the function of the charge control agent, the charge control agent needs to be exposed at the surface of toner. However, the quaternary ammonium salt compound is easily dissolved in water. Therefore, excess exposure of the quaternary ammonium salt compound at the surface of toner causes a disadvantage in handling the toner under the high-temperature atmosphere.

Hence, in order to maintain the charging property of the toner even after leaving it under the high-temperature atmosphere for a long time, i.e., in order to fully exhibit the effect produced by the addition of the quaternary ammonium salt compound, it is necessary to set the amount (concentration) of the quaternary ammonium salt compound to be exposed at the surface of toner within an optimum range.

In order to obtain the above-mentioned toner, it is important to set the conditions such as the temperature in melt-kneading the raw material mixture within a specific range according to the melting point of the quaternary ammonium salt compound.

Specifically, the toner needs to be produced by forming a melt-kneaded mixture by melt-kneading a raw material mixture containing a quaternary ammonium salt compound at a temperature within the range of from (M−7)° C. to (M+7)° C. where M is the melting point of the quaternary ammonium salt compound, with a kneading device having a discharge port whose temperature has been set so that the melt viscosity of the melt-kneaded mixture at the discharge port is not more than 10,000 Pa.s, rolling out the melt-kneaded mixture to a thickness between 1.2 mm and 3.0 mm, and then cooling down the mixture. Moreover, the toner is measured in accordance with a predetermined method using a solution produced by dissolving 100 mg of the toner in 50 ml of a solvent. More specifically, the supernatant of the solution is placed in a cell with a length of 1 cm, and measured. The toner contains a quaternary ammonium salt compound whose absorbance is within the range of from 0.2 to 0.4 at the absorption maximum wavelength (characteristic peak) of ultraviolet light. The toner that is produced by the above-mentioned process and satisfies the above-mentioned condition can retain an appropriate amount of charge during copying even after being left under the high-temperature atmosphere for a long time.

Hence, the present inventor found the toner capable of maintaining a good image density, and completed the invention.

Accordingly, the toner of the present invention is produced by the above-mentioned process, and contains the quaternary ammonium salt compound whose absorbance at the absorption maximum wavelength of ultraviolet light is within the range of from 0.2 to 0.4 when the supernatant of the solution produced by dissolving 100 mg of the toner in 50 ml of the solvent is placed in a cell with a length of 1 cm and measured by the predetermined method.

It is possible to adjust the amount (concentration) of the quaternary ammonium salt compound to be exposed at the surface of toner within an optimum range by dispersing the quaternary ammonium salt compound evenly. Therefore, even after leaving the toner under the high-temperature atmosphere for a long time, the toner can retain an appropriate amount of charge during copying, thereby maintaining a good image density. Namely, it is possible to improve the image quality. With the use of the toner with such a structure, it is possible to improve the charging stability and image stability during copying, and prevent the image carrier such as the photoreceptor from being made dirty (filmed with the toner).

Additionally, in order to achieve the above-mentioned object, a toner of the present invention contains a quaternary ammonium salt compound represented by general formula (1)

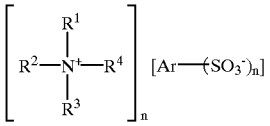

(1)

(where $R^1$, $R^2$, $R^3$ and $R^4$ independently represent an alkyl group with or without a substituent, or an aralkyl group with or without a substituent, Ar is an aromatic ring residue with or without a substituent, and n is a natural number). The toner having this structure can further improve the image quality.

Moreover, a toner of the present invention is produced from a raw material mixture containing at least a kind of binder resin selected from the group consisting of styrene resins, saturated polyester resin, and unsaturated polyester resin. The toner having this structure can further improve the image quality.

Besides, a developer of the present invention contains a toner produced by the above-mentioned process, and carrier.

With the use of the developer having this structure, it is possible to improve the charging stability and image stability during copying, and prevent the image carrier such as the photoreceptor from being made dirty (filmed with the developer).

The developer can contain carrier produced by coating a ferrite core material or iron core material with a silicone resin or fluoroplastic.

The developer having such a structure can further improve the charging stability and image stability during copying, and prevent the image carrier such as the photoreceptor from being made dirty (filmed with the toner).

The following description will explain the present invention in detail.

A toner of the present invention is produced by kneading a raw material mixture containing a binder resin, colorant, and quaternary ammonium salt compound. The toner can be positively charged toner or negatively charged toner. However, the positively charged toner is more preferable.

As the binder resin, it is possible to use known resins that are generally used for toner.

More specifically, examples of the binder resin are styrene resins such as polystyrene, polychloro styrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-acrylic acid copolymer, styrene-acrylic ester copolymer, styrene-methacrylic acid copolymer, styrene-methacrylic ester copolymer, styrene-α-chloromethyl acrylate copolymer, and styrene-acrylonitrile-acrylic ester copolymer; vinyl chloride resin; rosin modified maleic acid resin; phenol resin; epoxy resin; saturated polyester resin; unsaturated polyester resin; polyethylene resins such as polyethylene and ethylene-ethyl acrylate copolymer; polypropylene resin; ionomer resin; polyurethane resin; silicon resin; ketone resin; xylene resin; polyvinyl butyral resin; and polycarbonate resin. However, the binder resin is not particularly restricted to these materials.

The styrene resins are styrene, or a monopolymer or copolymer of styrene or derivatives thereof.

More specifically, examples of the styrene-acrylic ester copolymer include styrene-methyl acrylate copolymer, styrene-ethyl acrylate copolymer, styrene-butyl acrylate copolymer, styrene octyl acrylate copolymer, and styrene phenyl acrylate copolymer.

More specifically, examples of the styrene-methacrylic ester copolymer include styrene-methyl methacrylate copolymer, styrene-ethyl methacrylate copolymer, styrene-butyl methacrylate copolymer, styrene octyl methacrylate copolymer, and styrene phenyl methacrylate copolymer.

These binder resins are used alone, or in combination of two or more kinds thereof. Among the above-listed binder resins, the styrene resins, saturated polyester resin, and unsaturated polyester resin are more preferable. The process for preparing such a binder resin is not particularly restricted.

The glass transition temperature (Tg) of the binder resin is preferably not lower than 50° C., and more preferably not lower than 55° C. Glass transition temperatures lower than 50° C. are not preferred because, when the toner is left for a long time under a high-temperature atmosphere of, for example, 40° C. or more, the toner particles agglomerate or form a lump.

The flex temperature of the binder resin is preferably within the range of from 90° C. to 170° C., and more preferably from 100° C. to 150° C. A flex temperatures lower than 90° C. is not preferred because a so-called offset phenomenon occurs in the fixing step, i.e., the toner adheres to, for example, the fixing roller in fixing the copied image (toner image) to the transfer sheet. As a result, the fixing roller is made dirty, and the image quality is lowered. Additionally, a flex temperature exceeding 170° C. is not preferred because the adhesion strength of the toner to the transfer sheet becomes insufficient.

As the colorant, it is possible to use known pigments and dyes that are generally used for toner.

More specifically, examples of the colorant include inorganic pigments such as carbon black, iron black, Prussian Blue, chrome yellow, titanium oxide, zinc white, alumina white, and calcium carbonate; organic pigments such as copper phthalocyanine blue, Victorian Blue, copper phthalocyanine green, malachite green, Hansa Yellow G, benzidine yellow, Lake Red C, and quinacridone magenta; and organic dyes such as rhodamine dyes, triarylmethane dyes, anthraquinone dyes, monoazo dyes, and diazo dyes. However, the colorant is not particularly restricted to these pigments and dyes.

These colorants are used alone, or in combination of two or more kinds thereof according to a desired color of the toner. The colorant may be pre-treated by a known method, for example, a so-called "masterbatch" process.

The amount of colorant to be added is not particularly restricted, but is preferably within the range of from 1 part to 25 parts by weight, and more preferably from 3 parts to 20 parts by weight based on 100 parts by weight of the binder resin.

More specifically, examples of the quaternary ammonium salt compound include tetraethyl ammonium chloride $[(C_2H_5)_4N]^+Cl^-$, tetramethyl ammonium iodide $[(CH_3)_4N]^+I^-$, phenyl trimethyl ammonium iodide $[C_6H_5N(CH_3)_3]^+I^-$, and compounds represented by general formula (1)

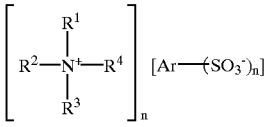

(1)

(where $R^1$, $R^2$, $R^3$ and $R^4$ independently represent an alkyl group with or without a substituent, or an aralkyl group with or without a substituent, Ar is an aromatic ring residue with or without a substituent, and n is a natural number). However, it is not necessarily to limit the quaternary ammonium salt compound to these compounds. The quaternary ammonium salt compound is a charge control agent.

In general formula (1), when the substituents denoted by $R^1$ to $R^4$ are of alkyl group, the number of carbons of the alkyl group is preferably within the range of from 1 to 24, and more preferably from 1 to 18. On the other hand, when the substituents denoted by $R^1$ to $R^4$ are of aralkyl group, the aralkyl group is preferably a benzyl group.

Specifically, the aromatic ring residue denoted by Ar in general formula (1) is, for example, benzene ring residue, naphthalene ring residue, and anthracene ring residue. In particular, the naphthalene ring residue is preferable.

As the substituent possessed by the aromatic ring residue, for example, alkyl group, hydroxyl group, amino group, and halogen group are listed. Among these substituents, the hydroxyl group and amino group are particularly preferable.

More specifically, examples of the quaternary ammonium salt compound represented by general formula (1) above include compounds a to j represented by the following chemical formulas.

[Compound a]

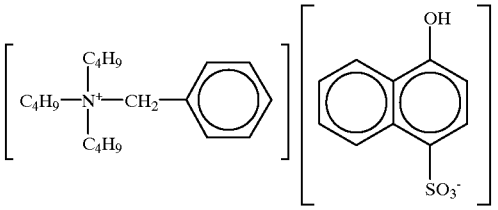

[Compound b]

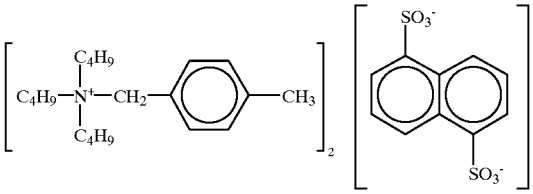

[Compound c]

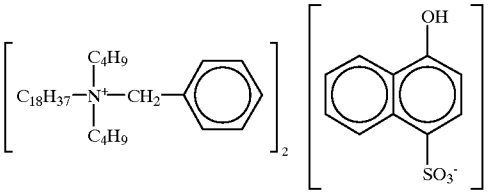

-continued

[Compound d]

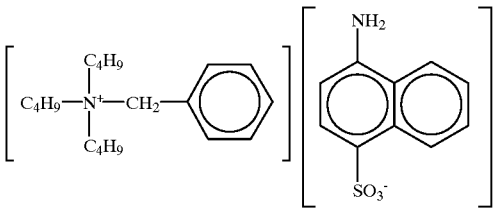

[Compound e]

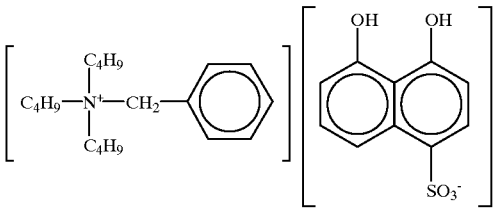

[Compound f]

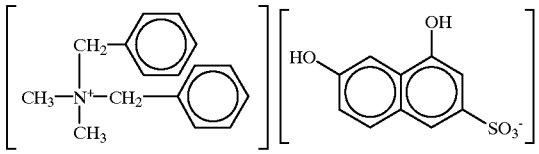

[Compound g]

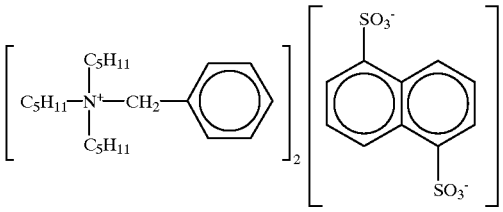

[Compound h]

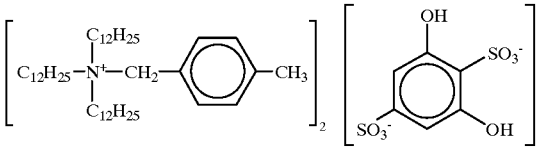

[Compound i]

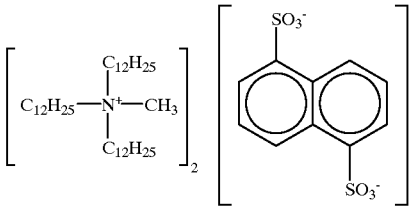

[Compound j]

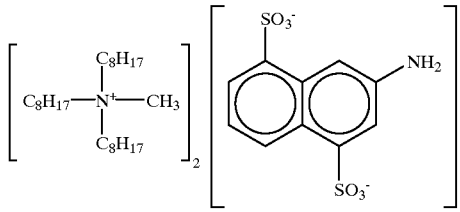

These quaternary ammonium salt compounds can be used alone or in combination of two or more kinds thereof.

Among the above compounds, the compounds a and b are particularly suitable for the quaternary ammonium salt compound.

The compound a is easily prepared by adding an aqueous sodium 4-hydroxy-1-naphthalenesulfonic acid solution dropwise to an aqueous benzyl tributyl ammonium chloride solution at room temperature while agitating the aqueous benzyl tributyl ammonium chloride solution, agitating the solutions at about 85° C. for one hour to carry out the reaction, cooling down the resultant product, and then performing predetermined separating/purifying processes such as filtration, washing, and drying.

With the use of the same process as the preparation process of the compound a, the compounds b to j can be easily prepared. However, the process for preparing the compounds a to j, i.e., the process for preparing the quaternary ammonium salt compound, is not particularly restricted. Namely, it is possible to prepare the quaternary ammonium salt compound by a known process including a so-called masterbatch process using a binder resin.

The amount of the quaternary ammonium salt compound is not particularly restricted, but is preferably within the range of from 0.05 part to 10 parts by weight, more preferably from 0.1 part to 8 parts by weight, and most preferably from 0.5 part to 5 parts by weight, based on 100 parts by weight of the binder resin.

When the amount of the quaternary ammonium salt compound is less than 0.05 part by weight, the amount of charge of the resultant toner does not reach a desired value. Thus, there is a possibility that the image quality is lowered. On the other hand, when the amount of the quaternary ammonium salt compound is more than 10 parts by weight, the photoreceptor (image carrier) of a copying machine (electrophotographic apparatus) is made dirty (filmed) with the quaternary ammonium salt compound separated from the toner, resulting in a lowering of the image quality.

The toner of the present invention may contain one or more kinds of charge control agents such as nigrosine compounds, polyamine resins, triamino triphenyl methane compounds, imidazole compounds, and styrene-amino acrylate copolymers, if necessary, as well as the quaternary ammonium salt compound. The amount of the charge control agent needs to be less than that of the quaternary ammonium salt compound, and preferably less than a half of the amount of the quaternary ammonium salt compound.

The raw material mixture can be easily prepared by mixing the binder resin, colorant, quaternary ammonium salt compound, etc. evenly with a mixer.

More specifically, examples of the mixer includes gravity-drop-type mixers such as V-type blender and ball mill; agitation-type mixers, for example, a Nautamixer from Hosokawa Micron Corporation; high-speed fluid mixers having a mixing blade, for example, a Super Mixer (available from Kawata Manufacturing Co., Ltd.) and a Henschel mixer (Mitsui Mike Machinery Co., Ltd). However, the mixer is not necessarily limited to these mixers. The mixing conditions in the mixer is not particularly restricted.

The melt-kneaded mixture can be easily obtained by placing the raw material mixture in a kneading device, and melt-kneading the mixture under predetermined conditions.

As the kneading device, it is suitable to use an extruding-type single-screw or twin-screw kneader. More specifically, examples of the kneading device include a kneader from Georg Fischer Corporation, a TEM-type twin-screw kneader from Toshiba Machine Co., Ltd., a KTK-type twin-screw kneader from Kobe Steel, Ltd., and a PCM-type twin-screw kneader from Ikegai Corporation. However, the kneading device is not necessarily limited to these kneaders.

The kneading device needs to have a discharge port whose temperature is set so that the melt viscosity of the melt-kneaded mixture at the discharge port is not more than 10,000 Pa.s, and a structure capable of melt-kneading the raw material mixture at a temperature within the range of from (M−7)° C. to (M+7)° C., and more preferably from (M−5)° C. to (M+5)° C. where M is the melting point of the quaternary ammonium salt compound.

Namely, the kneading device needs to have a structure capable of setting the melt-kneading temperature so that the temperature of the melt-kneaded mixture is within the range of from (M−7)° C. to (M+7)° C., and more preferably from (M−5)° C. to (M+5)° C., and setting the temperature at the discharge port so that the melt viscosity of the melt-kneaded mixture is not more than 10,000 Pa.s.

In short, the kneading temperature in kneading the raw material mixture is preferably within the range of from (M−7)° C. to (M+7)° C., and more preferably from (M−5)° C. to (M+5)° C. where M is the melting point of the quaternary ammonium salt compound.

When the raw material mixture is melt-kneaded within the above-mentioned temperature range, the melt-kneaded mixture does not have a liquid phase in the kneading device. It is thus possible to produce a toner that contains the quaternary ammonium salt compound dispersed evenly and retains an appropriate amount of charge during copying irrespectively of the working atmosphere. For example, the amount of charge of the toner can be retained in an appropriate range even after the toner was left under the high-temperature atmosphere for a long time.

When the kneading temperature is higher than (M+7)° C., since the melt-kneaded mixture has a substantially liquid phase in the kneading device, the effect of dispersing the quaternary ammonium salt compound by kneading is reduced. As a result, the composition of the melt-kneaded mixture becomes uneven, and the resultant toner has an excessive amount of charge.

On the other hand, when the kneading temperature is lower than (M−7)° C., the quaternary ammonium salt compound cannot be evenly dispersed in the resultant toner. Moreover, the amount of charge of the toner becomes too small. As a result, the toner is scattered through a developing sleeve. Namely, the toner is scattered in the copying machine.

In addition, it is preferable to set the temperature at the discharge port of the kneading device so that the melt viscosity of the melt-kneaded mixture at the discharge port is not more than 10,000 Pa.s. By setting the temperature at the discharge port in this manner, it is possible to improve the charging stability and image stability of the toner particularly under a high-temperature high-humidity atmosphere (for example, a temperature of 35° C. and a relative humidity of 85%) and of the toner after being left under the high-temperature atmosphere for a long time, and prevent the image carrier such as the photoreceptor from being made dirty (filmed with the toner).

When the temperature at the discharge port is set so that the melt viscosity of the melt-kneaded mixture at the discharge port is not more than 10,000 Pa.s, since the melt-kneaded mixture is in a substantially liquid phase at the discharge port, the dispersibility of the quaternary ammonium salt compound in the toner is degraded.

The upper limit of the melt viscosity of the melt-kneaded mixture is not particularly restricted, but is preferably less than 160,000 Pa.s. Namely, the temperature at the discharge port of the kneading device is preferably set higher than a temperature at which the melt viscosity of the melt-kneaded mixture at the discharge port is not less than 160,000 Pa.s.

The kneading conditions other than the melt-kneading temperature and the temperature at the discharge port in the kneading device, for example, the shapes of blade and screw of the kneading device, the rotation speed of the screw, and the kneading time, are not particularly restricted. Besides, the method of removing the melt-kneaded mixture from the kneading device is not particularly restricted. The above-mentioned range of the kneading temperature and value of the melt viscosity were calculated from the results of experiments.

When rolling out the melt-kneaded mixture removed from the kneading device, it is preferable to use a rolling mill. Specifically, an example of the rolling mill is a drum flaker from Mitsui Mining Co., Ltd. However, it is not necessary to limit the rolling mill to the drum flaker. Namely, it is possible to use any rolling mill if it can roll out the melt-kneaded mixture to a thickness within the range of 1.2 mm to 3.0 mm.

It is preferable to roll out the melt-kneaded mixture to a thickness within the range of 1.2 mm to 3.0 mm. With such a thickness, the melt-kneaded mixture can be cooled down efficiently while maintaining a state in which the quaternary ammonium salt compound is evenly dispersed.

Consequently, a toner containing the evenly dispersed quaternary ammonium salt compound is obtained. Namely, the amount of charge of toner during copying can be retained in an appropriate range irrespectively of the working atmosphere and conditions of use. Moreover, the amount of charge of the toner during copying can be retained in the appropriate range even after the toner was left under the high-temperature atmosphere for a long time.

Accordingly, it is possible to produce a toner capable of maintaining a good image density, and preventing the image carrier such as the photoreceptor from being made dirty.

When the thickness of the melt-kneaded mixture is more than 3.0 mm, it takes too much time for cooling down the melt-kneaded mixture. Therefore, the state in which the quaternary ammonium salt compound is evenly dispersed cannot be maintained.

Namely, the toner containing the evenly dispersed quaternary ammonium salt compound cannot be obtained. In addition, the charging stability decreases, and the image carrier is made dirty during copying. Moreover, since the amount of charge of the toner becomes too small, the toner is scattered through the developing sleeve. In short, the toner is scattered in the copying machine. The dart tends to be induced by a mold releasing agent (to be described later) separated from the toner composition.

By cooling down and setting the melt-kneaded mixture rolled out to a thickness within the range of from 1.2 mm to 3.0 mm, toner in the shape of a plate is produced. This plate-like toner is ground and classified by a generally used known method to provide toner in the form of powder.

Accordingly, the toner of the present invention is obtained. Namely, the toner of the present invention is produced by melt-kneading the raw material mixture using a kneading device with the above-mentioned structure, removing the resultant melt-kneaded mixture from the kneading device, rolling out the melt-kneaded mixture to a thickness within the range of from 1.2 mm to 3.0 mm, and cooling down the mixture. The average particle diameter of the toner is preferably within the range of from 3 $\mu$m to 20 $\mu$m, and more preferably from 5 $\mu$m to 15 $\mu$m.

The peak area of the thermal analysis absorption peak of the quaternary ammonium salt compound per unit weight of the raw material mixture is smaller after melt-kneading the raw material mixture than before melt-kneading the raw material mixture.

The toner produced by the process of the present invention satisfies inequality (I)

$$(B/A)<0.2 \quad \text{(I)}$$

where A is the peak area of the thermal analysis absorption peak of a quaternary ammonium salt compound per unit weight of a raw material mixture (hereinafter referred to as the area A), and B is the peak area of the thermal analysis absorption peak of the quaternary ammonium salt compound per unit weight of the toner produced from the raw material mixture (hereinafter referred to as the area B), under the same conditions. Consequently, the toner satisfying inequality (I) is produced by the process of the present invention.

The thermal analysis of the raw material mixture and toner can be performed using thermal analyzers, such as a commercially available differential thermal analyzer and differential scanning calorimeter. The analyzing method and analyzing conditions are not particularly restricted.

Moreover, the method of calculating the areas A and B is not particularly restricted. Examples of the calculation method are: a gravimetric method in which the peak area is calculated by cutting off a segment showing the absorption peak from a recording sheet subjected to thermal analysis and measuring the weight thereof; a half-power bank width method in which the peak area is calculated by approximating the segment with the absorption peak to the shape of a triangle; an observation method in which the peak area is calculated using a planimeter; and an image analysis method in which the peak area is calculated using an area analytic program.

A quaternary ammonium salt compound contained in the toner of the present invention is amorphous. Therefore, the charge of the toner is relatively stable during copying. Namely, the toner can retain an appropriate amount of charge irrespectively of the working atmosphere during copying.

On the other hand, a quaternary ammonium salt compound contained in a toner which does not satisfy inequality (I) above is crystalline. In this case, the charge of the toner is not stable during copying. In other words, the toner cannot retain an appropriate amount of charge during copying.

Meanwhile, the toner produced by the above-mentioned process is measured in accordance with a predetermined method (spectroscopic analysis). More specifically, a solution is prepared by dissolving 100 mg of the toner in 50 ml of a solvent, and a predetermined amount of the supernatant of the resultant solution is placed in a measuring cell with a length of 1 cm. The toner contains a quaternary ammonium salt compound whose absorbance at the absorption maximum wavelength (characteristic peak) of ultraviolet light is within the range of from 0.2 to 0.4.

The absorption maximum wavelength appears in the vicinity of 300 nm. The absorbance is proportional to the concentration of the quaternary ammonium salt compound at the surface of toner.

As the solvent, it is possible to use any compounds that are suitable for the measurement of absorbance and capable of dissolving the quaternary ammonium salt compound. More specifically, examples of the solvent are water, and alcohols such as methyl alcohol. However, the solvent is not necessarily limited to these compounds. The measurement of absorbance can be performed using a commercially available spectrophotometer. The measuring method and measuring conditions other that those specified above are not particularly restricted.

The following description will explain in detail the method of measuring the absorbance.

First, a quaternary ammonium salt compound to be used for toner is dissolved in a solvent, for example, methyl alcohol.

Then, a predetermined amount of the resultant solution is placed in a measuring quarts cell with a cell length of 1 cm, and measured in accordance with a predetermined method so as to find the position of the characteristic peak of the quaternary ammonium salt compound to ultraviolet light.

Next, 100 mg of the toner using the quaternary ammonium salt compound is dissolved in 50 ml of the solvent (methyl alcohol), and then centrifuged.

After placing a predetermined amount of the supernatant of the solution in the measuring quartz cell, the characteristic peak is measured by the same measuring method.

When only the quaternary ammonium salt compound contained in the toner is dissolved in the solvent, i.e., when substances other than the quaternary ammonium salt compound are not dissolved in the solvent, the absorbance of the quaternary ammonium salt compound is given by the above-mentioned measurement.

On the other hand, when, for example, a binder resin is dissolved in the solvent, a toner that containing no quaternary ammonium salt compound (a toner for a blank measurement) is prepared, and the supernatant of the toner solution is produced as a reference solution in the same manner as above.

With the use of the reference solution, the characteristic peak of the toner containing the quaternary ammonium salt compound is measured.

With this method, since the effect of the substance (for example, the binder resin) other than the quaternary ammonium salt compound is cancelled, the absorbance of the quaternary ammonium salt compound can be obtained by the above-mentioned measurement.

In order to further improve the physical properties and thermal properties of the toner, or the flowability and anti-agglomeration property of the toner, it is possible to add generally used known assistants, external additives, mold releasing agent, etc. to the toner, if necessary.

More specifically, examples of the assistants are polyalkylene wax, paraffine wax, higher fatty acid, fatty amide, and metallic soap. However, the assistants are not necessarily limited to these materials.

Examples of the external additives include fine particles of metal oxides, such as titania, silica, alumina, magnetite, and ferrite; fine particles of synthetic resins, such as acrylic resins and fluoroplastics; and hydrosulphite. However, the external additives are not necessarily limited to these materials.

As the mold releasing agent, for example, it is possible to use polyethylene, and polypropylene. However, the mold releasing agent is not necessarily limited to these materials.

By adding such assistants, external additives and mold releasing agent, etc. to the toner, a toner composition is obtained.

The amount of the assistant to be added is not particularly restricted, but is preferably within the range of from 0.1 part to 10 parts by weight based on 100 parts by weight of the binder resin.

The amount of the external additive to be added is not particularly restricted, but is preferably within the range of from 0.01 part by weight to 5 parts by weight based on 100 parts by weight of the binder resin.

The method of adding the assistant, external additive, mold releasing agent, etc. is not particularly restricted.

By mixing the toner (or toner composition) and carrier, a developer of the present invention is produced.

The carrier is not particularly restricted, and a known magnetic material that is generally used for developer can be used. More specifically, examples of the carrier include iron powder, magnetite powder, ferrite powder, and so-called magnetic resin carrier. It is also possible to use carriers produced by using such a material as a core material and coating the core material with a silicone resin, fluoroplastic, acrylic resin, styrene resin, epoxy resin, saturated polyester resin, unsaturated polyester resin, polyamide resin, etc.

Among the carriers, it is preferable to use carrier produced by coating a ferrite or iron core material with a silicone resin or fluoroplastic. It is particularly preferable to use carrier produced by coating the iron core material with the fluoroplastic, and carrier produced by coating the ferrite core material with a silicone resin. The average particle diameter of the carrier is preferably within the range of from 20 $\mu$m to 200 $\mu$m.

The developer of the present invention can retain an appropriate amount of charge during copying irrespectively of the working atmosphere and conditions of use. This developer can also retain the appropriate amount of charge during copying even after being left under the high-temperature atmosphere for a long time.

It is thus possible to maintain a good image density, thereby improving the image quality. Namely, with the use of the developer, it is possible to improve the charging stability and image stability during copying, and prevent the image carrier such as the photoreceptor from being made dirty (filmed with the developer).

For a fuller understanding of the nature and advantages of the invention, reference should be made to the ensuing detailed description taken in conjunction with the accompanying drawings.

DESCRIPTION OF THE PREFERRED EMBODIMENT

Figure 1:
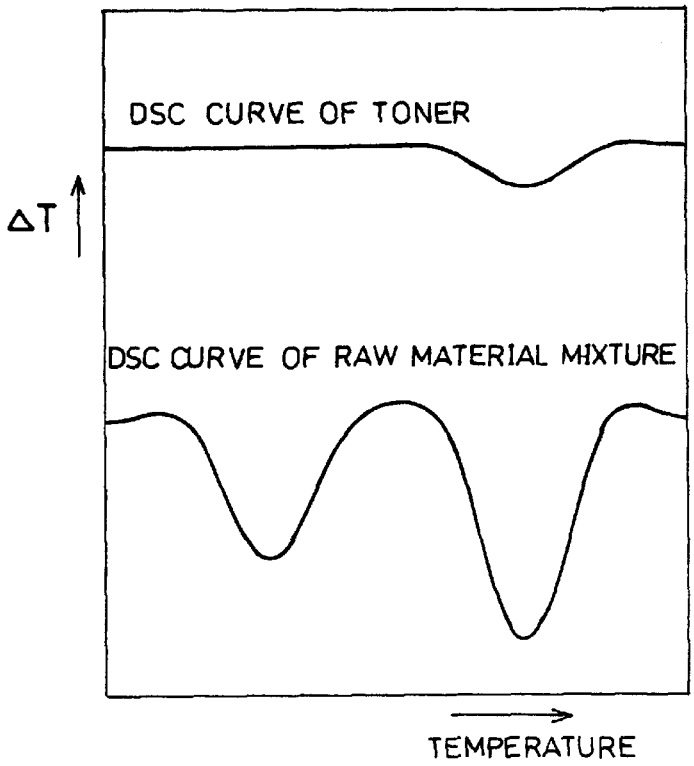
FIG. 1 is a chart of the differential scanning calorimetry of a raw material mixture and toner obtained as an example of the present invention.

The following description will explain the present invention in detail by presenting some examples and comparative examples. However, the present invention is not limited to these examples. The term "part" mentioned in the following examples and comparative examples means"part by weight".

The melt viscosity of the melt-kneaded mixture in removing the melt-kneaded mixture from the kneading device was measured under predetermined conditions with an E-type viscometer (Toki Sangyo Co., Ltd.).

The area A of the thermal analysis absorption peak of a quaternary ammonium salt compound per unit weight of a raw material mixture, and the area B of the thermal analysis absorption peak of the quaternary ammonium salt compound per unit weight of a toner were measured by measuring the raw material mixture and toner with the DSC (differential scanning calorimetry) technique using a differential scanning calorimeter "SCC/5200" (available from Seiko Instruments Inc.), under the following conditions.

Specifically, $\alpha$-$Al_2O_3$ was used as a reference material. About 20 mg of a test sample was weighed using an aluminum cell with a lid. The measurement was performed by heating the sample to 250° C. at a heating rate of 10° C./minute.

The total peak area of the absorption peak of the quaternary ammonium salt compound was read from the DSC curve (measured data) by using the gravimetric analysis technique, after performing a base line correction, if necessary. The peak area of the thermal analysis absorption peak of the quaternary ammonium salt compound per unit weight of the sample was calculated by dividing the total peak area by the weight of the sample.

The area A and area B were measured by performing the above-mentioned measurement and procedure with respect to the raw material mixture and toner, and the ratio of area A to area B (B/A) was calculated.

The area A of the thermal analysis absorption peak of the quaternary ammonium salt compound per unit weight of the raw material and the area B of the thermal analysis absorption peak of the quaternary ammonium salt compound per unit weight of the toner will be explained later with reference to Examples 1 to 5 and Comparative Examples 1 to 5.

The absorbance of the quaternary ammonium salt compound at the absorption maximum wavelength of ultraviolet light was measured (spectroscopic analysis) under the following conditions using a spectrometer "U2000" (from Hitachi, Ltd.).

Specifically, 100 mg of the toner was added to 50 ml of methyl alcohol as a solvent, dispersed (dissolved) sufficiently by applying ultrasonic waves for 10 minutes, and then centrifuged using a centrifugal separator. Next, the supernatant of the resultant solution was placed in a quartz cell with a cell length of 1 cm, and the absorbance at the absorption maximum wavelength (characteristic peak) in the vicinity of 300 nm was measured according to a predetermined method.

The absorbance of the quaternary ammonium salt compound at the absorption maximum wavelength of ultraviolet light will be explained below with reference to Examples 6 to 14 and Comparative Examples 6 to 14.

Copy tests of developer were carried out using a commercially available copying machine and transfer sheets, under a normal atmosphere (with a temperature of 25° C. and a relative humidity of 60%) and a high-temperature high-humidity atmosphere (with a temperature of 35° C. and a relative humidity of 85%).

The charge amount $\mu$ (C/g) of the toner was measured using a blow-off charge meter (from Toshiba Chemical Corporation). The image density of the copied image (toner image) was measured using a Macbeth densitometer (available from Macbeth Division of Kollmorgen Instrument Corporation). The fog was measured with a Z-II OPTICAL SENSOR (from Nippon Denshoku Kogyo Co., Ltd.). The fog means a phenomenon that the white portion of a transfer sheet to which the copied image is transferred overlaps the copied image.

The charge amount $\mu$ (C/g), image density, and fog were measured at the beginning of copying (hereinafter just referred to as "beginning"), and after producing 5,000 sheets of copies and 10,000 sheets of copies (hereinafter just referred to as "after 5,000 copies" and "10,000 copies", respectively).

In the measurements, the state of scattered toner through the developing sleeve, i.e., the state of scattered toner in the copying machine (hereinafter referred to as scattering of toner) was observed, and evaluated by three levels. A state in which there was no scattered toner was judged "o", a state in which the toner was slightly scattered was "Δ", and a state in which the toner was scattered was "x".

Then, the copy quality was evaluated totally by three levels, based on the results of measuring the charge amount $\mu$ (C/g), image density, fog, and scattering of toner. A state in which quality copies were produced without scattering toner was judged "o", a state in which quality copies were produced but the toner was scattered was "Δ", and a state in which the copies were not in good condition and the toner was scattered was "x".

Referring now to Examples 1 to 5 and Comparative Examples 1 to 5, the following description will explain the area A of the thermal analysis absorption peak of the quaternary ammonium salt compound per unit weight of the raw material mixture, and the area B of the thermal analysis absorption peak of the quaternary ammonium salt compound per unit weight of the toner.

[EXAMPLE 1]

A raw material mixture was prepared by placing and mixing 100 parts of styrene-acrylic acid copolymer (available from Sanyo Chemical Industries, Ltd.), 2 parts of polyethylene "PE-130" (Hoechst Ltd.) and 2 parts of polypropylene "Viscol 550P" (Sanyo Chemical Industries, Ltd.) as binder resins, 5 parts of carbon "MA-100S" (Mitsubishi Chemical Corporation) as a colorant, and 2 parts of a compound a (with a melting point of 188° C.) as a quaternary ammonium salt compound in the Super Mixer (Kawata Manufacturing Co., Ltd.) as a mixer.

Subsequently, the raw material mixture was placed in a twin-screw kneader "PCM65" (Ikegai Corporation) as a kneading device. Then, the melt-kneading temperature of the kneader was set so that the temperature of the melt-kneaded raw material mixture, i.e., the melt-kneaded mixture, was 185° C. (when measured by a contact thermometer), and the temperature at the discharge port of the kneader was set at 160° C.

Thus, the difference between the melting point of the compound a and the melt-kneading temperature (|melt-kneading temperature−melting point|) was 3° C. The raw material mixture was melt-kneaded (twin-screw kneaded) under the following conditions until an evenly-mixed melt-kneaded mixture was obtained.

Thereafter, the melt-kneaded mixture was removed from the kneader, rolled out to a thickness of 1.5 mm with a rolling mill "Drum Flaker" (from Mitsui Mining Co., Ltd), and then cooled down. The melt viscosity of the melt-kneaded mixture at the discharge port of the kneader, i.e., the melt viscosity of the melt-kneaded mixture at 160° C., was 40,000 Pa.s.

Next, the resultant rolled mixture (kneaded mixture) was ground and classified to provide toner with an average particle diameter of 10 μm.

The raw material mixture and the toner were analyzed by differential scanning calorimetry to investigate the area A of the thermal analysis absorption peak of the compound a per unit weight of the raw material mixture, and the area B of the thermal analysis absorption peak of the compound a per unit weight of the toner. Moreover, the ratio of area A to area B (B/A) was calculated. FIG. 1 shows the chart of the differential scanning calorimetry (DSC curve). The compound a in the raw material mixture had two absorption peaks.

According to the results, the ratio of area A to area B (B/A) was 0.1. Thus, this toner satisfied inequality (I) mentioned above. Accordingly, the toner of the present invention was obtained.

Next, 100 parts of the toner, 0.1 part of silica powder "R972" (available from Nippon Aerosil Co., Ltd.), 0.1 part of magnetite powder "KBC100" (Kanto Denka Kogyo Co., Ltd.), and 0.1 part of hydrosulphite powder "ALCA-4" (Kyowa Chemical Industry Co., Ltd.) were added as external additives to the mixer so as to prepare a toner composition.

Moreover, 4 parts of the toner composition, and 100 parts of ferrite carrier produced by coating a ferrite core material with a silicon resin were placed in the Nautamixer (from Hosokawa Micron Corporation) as a mixer. Then, the toner composition and ferrite carrier were mixed by agitation so as to produce a developer of the present invention.

Copy tests were performed using the resultant developer. The results are shown in Table 1. It can be understood from the results that the amount of toner was stably retained in an appropriate range, the image density was stably high, and fog did not substantially occur, under both the normal atmosphere and high-temperature high-humidity atmosphere. Besides, scattering of toner was "o". Accordingly, under both the working atmospheres, the overall evaluation was "o".

[EXAMPLE 2]

A toner with an average particle diameter of 10 μm was prepared in the same manner as in Example 1, except that the melt-kneading temperature of the twin-screw kneader was set so that the temperature of the melt-kneaded mixture was 192° C. (when measured by a contact thermometer), the temperature at the discharge port of the kneader was set at 170° C., and the melt-kneaded mixture was rolled out to a thickness of 2.8 mm. The difference between the melting point of the compound a and the melt-kneading temperature was 4° C. The melt viscosity of the melt-kneaded mixture at 170° C. was 23,500 Pa.s.

Figure 2:
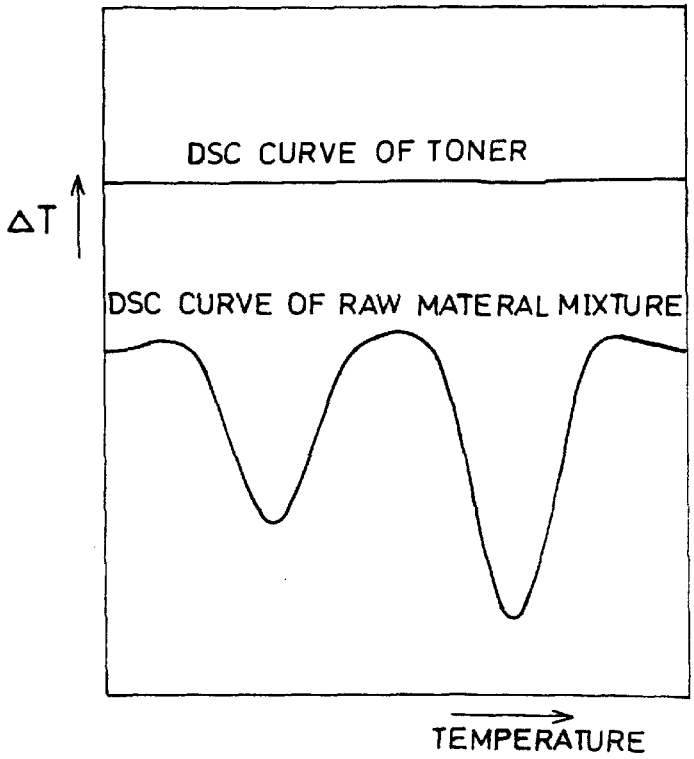
FIG. 2 is a chart of the differential scanning calorimetry of a raw material mixture and toner obtained as another example of the present invention.

Like Example 1, the raw material mixture and the toner were analyzed by differential scanning calorimetry. FIG. 2 shows the chart of the differential scanning calorimetry (DSC curve). According to the results, the ratio of area A to area B (B/A) was 0. Thus, this toner satisfied inequality (I) mentioned above. Accordingly, the toner of the present invention was obtained.

Next, after preparing a toner composition by performing the same procedure as in Example 1, 4 parts of the toner composition and 100 parts of iron carrier (with an average particle diameter of 100 μm) produced by coating an iron core material (iron powder) with a fluoroplastic were placed in the Nautamixer (from Hosokawa Micron Corporation) as the mixer. Then, the toner composition and iron carrier were mixed by agitation so as to produce a developer of the present invention.

Copy tests were performed using the resultant developer. The results are shown in Table 1. It can be understood from the results that the amount of charge was stably retained in the appropriate range, the image density was stably high, and fog did not substantially occur, under both the normal atmosphere and high-temperature high-humidity atmosphere. Besides, scattering of toner was "o". Accordingly, under both the working atmospheres, the overall evaluation was "o".

[EXAMPLE 3]

A toner with an average particle diameter of 10 μm was prepared in the same manner as in Example 1, except that 2 parts of a compound b (with a melting point of 195° C.) as a quaternary ammonium salt compound was used instead of the compound a, the melt-kneading temperature of the twin-screw kneader was set so that the temperature of the melt-kneaded mixture was 190° C. (when measured by a contact thermometer), the temperature at the discharge port of the kneader was set at 165° C., and the melt-kneaded mixture was rolled out to a thickness of 2.3 mm. The difference between the melting point of the compound b and the melt-kneading temperature was 5° C. The melt viscosity of the melt-kneaded mixture at 165° C. was 27,000 Pa.s.

Figure 3:
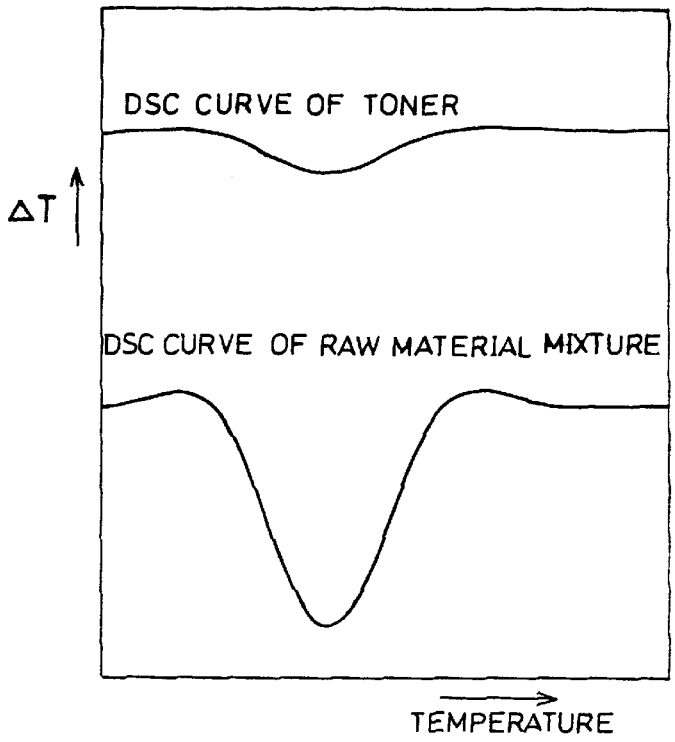
FIG. 3 is a chart of the differential scanning calorimetry of a raw material mixture and toner obtained as other example of the present invention.

Like Example 1, the raw material mixture and the toner were analyzed by differential scanning calorimetry. FIG. 3 shows the chart of the differential scanning calorimetry (the DSC curve). According to the results, the ratio of area A to area B (B/A) was 0.19. Thus, this toner satisfied inequality (I) mentioned above. Hence, the toner of the present invention was obtained.

Next, by performing the same procedure as in Example 1, a developer of the present invention was produced. Copy tests were performed using the resultant developer. The results are shown in Table 1. It can be understood from the results that the amount of charge was stably retained in the appropriate range, the image density was stably high, and fog did not substantially occur, under both the normal atmosphere and high-temperature high-humidity atmosphere. Besides, scattering of toner was "o". Accordingly, under both the working atmospheres, the overall evaluation was "o".

[EXAMPLE 4]

A toner with an average particle diameter of 10 μm was prepared in the same manner as in Example 1, except that 2 parts of the compound b (with a melting point of 195° C.) was used instead of the compound a, the melt-kneading temperature of the twin-screw kneader was set so that the temperature of the melt-kneaded mixture was 197° C. (when measured by a contact thermometer), the temperature at the discharge port of the kneader was set at 180° C., and the melt-kneaded mixture was rolled out to a thickness of 2.0 mm. The difference between the melting point of the compound b and the melt-kneading temperature was 2° C. The melt viscosity of the melt-kneaded mixture at 180° C. was 15,200 Pa.s.

Figure 4:
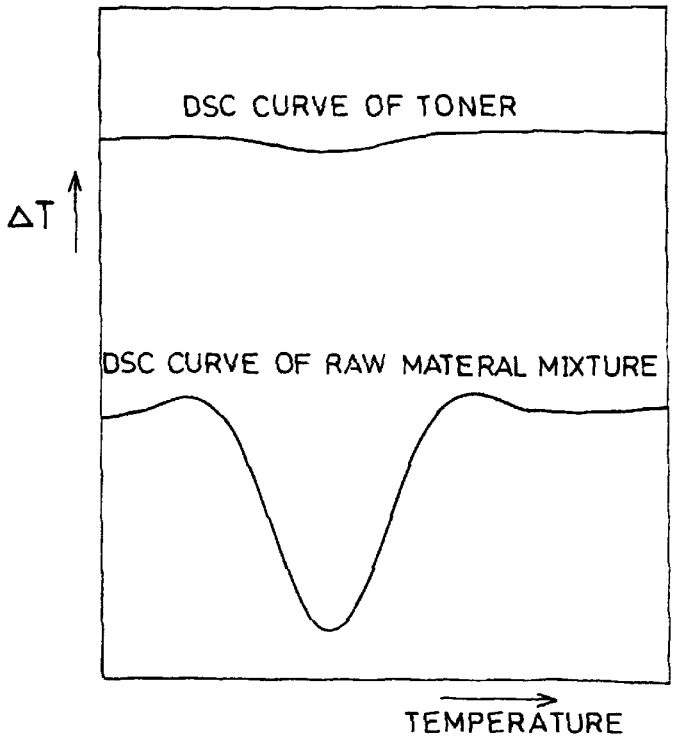
FIG. 4 is a chart of the differential scanning calorimetry of a raw material mixture and toner obtained as other example of the present invention.

Like Example 1, the raw material mixture and the toner were analyzed by differential scanning calorimetry. FIG. 4 shows the chart of the differential scanning calorimetry (DSC curve). According to the results, the ratio of area A to area B (B/A) was 0.05. Thus, this toner satisfied inequality (I) mentioned above. Accordingly, the toner of the present invention was obtained.

Next, a developer of the present invention was produced by following the same procedure as in Example 2. Copy tests were performed using the resultant developer. The results are shown in Table 2. It can be understood from the results that the amount of charge was stably retained in the appropriate range, the image density was stably high, and fog did not substantially occur under both the normal atmosphere and high-temperature high-humidity atmosphere. Besides, scattering of toner was "o". Accordingly, the overall evaluation was "o" under both the working atmospheres.

[EXAMPLE 5]

A toner with an average particle diameter of 10 μm was prepared in the same manner as in Example 1, except that the melt-kneading temperature of the twin-screw kneader was set so that the temperature of the melt-kneaded mixture was 195° C. (when measured by a contact thermometer). The difference between the melting point of the compound a and the melt-kneading temperature was 7° C.

Figure 5:
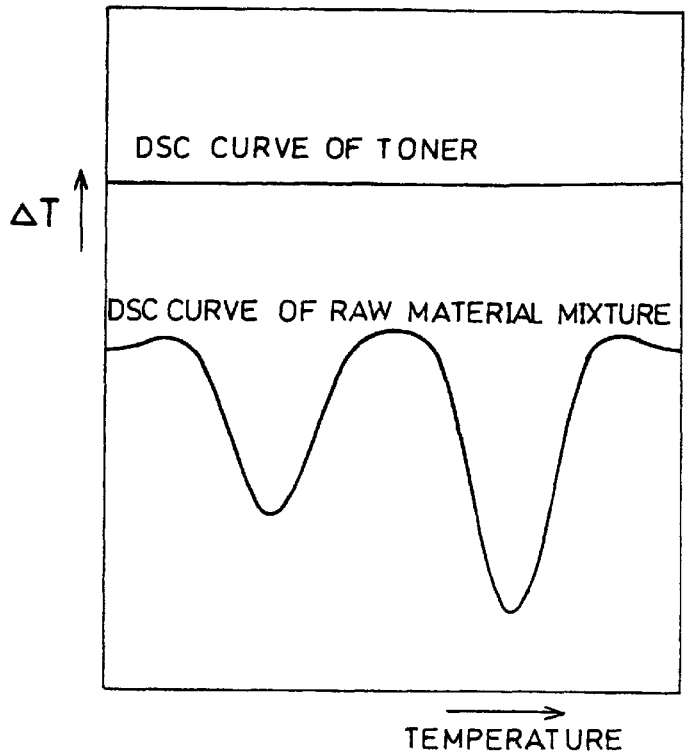
FIG. 5 is a chart of the differential scanning calorimetry of a raw material mixture and toner obtained as other example of the present invention.

Like Example 1, the raw material mixture and the toner were analyzed by differential scanning calorimetry. FIG. 5 shows the chart of the differential scanning calorimetry (DSC curve). According to the results, the ratio of area A to area B (B/A) was 0. Thus, this toner satisfied inequality (I) mentioned above. Hence, the toner of the present invention was obtained.

Next, a developer of the present invention was produced by following the same procedure as in Example 1. Copy tests were performed using the resultant developer. The results are shown in Table 2. It is clear from the results that the amount of charge was stably retained in the appropriate range, the image density was stably high, and fog did not substantially occur under both the normal atmosphere and high-temperature high-humidity atmosphere. However, scattering of toner was "x". Accordingly, the overall evaluation was "Δ" under both the working atmospheres.

[COMPARATIVE EXAMPLE 1]

A toner with an average particle diameter of 10 μm was prepared in the same manner as in Example 1, except that the melt-kneading temperature of the twin-screw kneader was set so that the temperature of the melt-kneaded mixture was 178° C. (when measured by a contact thermometer). The difference between the melting point of the compound a and the melt-kneading temperature was 10° C. Thus, the melt-kneading temperature was out of the above-mentioned range.

Figure 6:
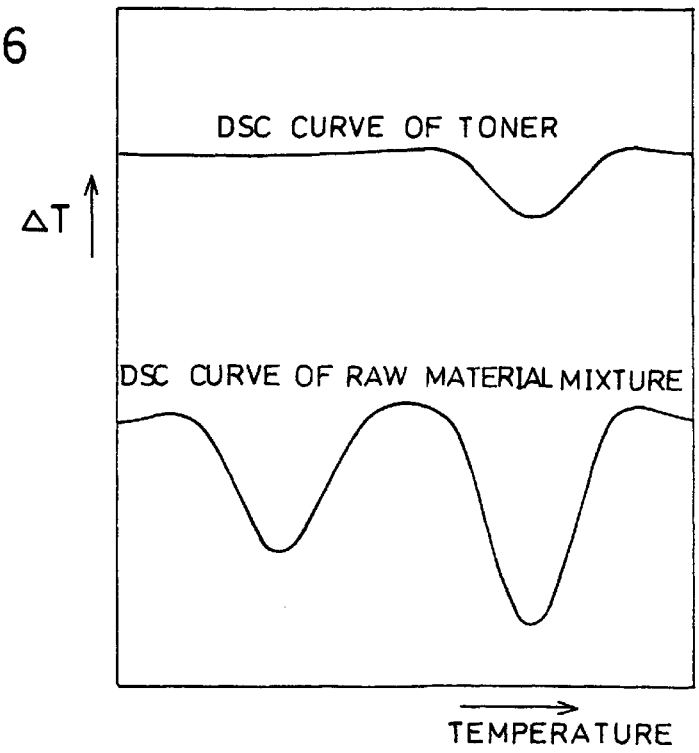
FIG. 6 is a chart of the differential scanning calorimetry of a raw material mixture and comparative toner obtained as a comparative example of the present invention.

Like Example 1, the raw material mixture and the toner were analyzed by differential scanning calorimetry. FIG. 6 shows the chart of the differential scanning calorimetry (DSC curve). According to the results, the ratio of area A to area B (B/A) was 0.3. Thus, this toner did not satisfy inequality (I) mentioned above. Accordingly, a comparative toner was prepared.

Next, a comparative developer was produced by following the same procedure as in Example 1. Copy tests were performed using the resultant developer. The results are shown in Table 2. It can be understood from the results that, under the normal atmosphere, the amount of charge was lowered with an increase in the number of copies produced, and the degree of fog became higher with an increase in the number of copies produced. This tendency was more noticeable under the high-temperature high-humidity atmosphere. In this case, scattering of toner was "x". Accordingly, the overall evaluation was "x" under both the working atmospheres.

[COMPARATIVE EXAMPLE 2]

A toner with an average particle diameter of 10 μm was prepared in the same manner as in Example 2, except that the melt-kneaded mixture was rolled out to a thickness of 1.0 mm. Thus, the thickness of the melt-kneaded mixture was out of the above-mentioned range. Like Example 1, the raw material mixture and the toner were measured by differential scanning calorimetry. The same results as in Example 2 were obtained. Accordingly, a comparative toner was prepared.

Next, a comparative developer was produced by following the same procedure as in Example 2. Copy tests were performed using the resultant developer. The results are shown in Table 3. It is clear from the results that, under the normal atmosphere, although the amount of charge was slightly lowered on the whole and the degree of fog was slightly increased on the whole, the image density was stably high. However, under the high-temperature high-humidity atmosphere, the amount of charge was lowered with an increase in the number of copies produced, and the degree of fog became higher with an increase in the number of copies produced. In this case, scattering of toner was "x", and the photoreceptor was made dirty by the toner adhering thereto. Accordingly, the overall evaluation was "Δ" under the normal atmosphere, and "x" under the high-temperature high-humidity atmosphere.

[COMPARATIVE EXAMPLE 3]

A toner with an average particle diameter of 10 μm was prepared in the same manner as in Example 2, except that the melt-kneaded mixture was rolled out to a thickness of 3.5 mm. Thus, the thickness of the melt-kneaded mixture was out of the above-mentioned range. Like Example 1, the raw material mixture and the toner were analyzed by differential scanning calorimetry. The same results as in Example 2 were obtained. Accordingly, a comparative toner was prepared.

Next, a comparative developer was produced by following the same procedure as in Example 2. Copy tests were performed using the resultant developer. The results are shown in Table 3. It can be understood from the results that scattering of toner was "o". Moreover, under the high-temperature high-humidity atmosphere, although the degree of fog was slightly increased on the whole, the amount of charge was stably retained in the appropriate range, and the image density was stably high. However, under the normal atmosphere, the amount of charge was increased with an increase in the number of copies produced, and the image density was lowered with an increase in the number of copies produced. Accordingly, the overall evaluation was "x" under the normal atmosphere, and "Δ" under the high-temperature high-humidity atmosphere.

[COMPARATIVE EXAMPLE 4]

A toner with an average particle diameter of 10 μm was prepared in the same manner as in Example 3, except that the temperature at the discharge port of the kneader was set at 200° C. The melt viscosity of the melt-kneaded mixture at the discharge port of the kneader, i.e., the melt viscosity of the melt-kneaded mixture at 200° C., was 8,900 Pa.s. Thus, the temperature at the discharge port was out of the above-mentioned range.

Figure 7:
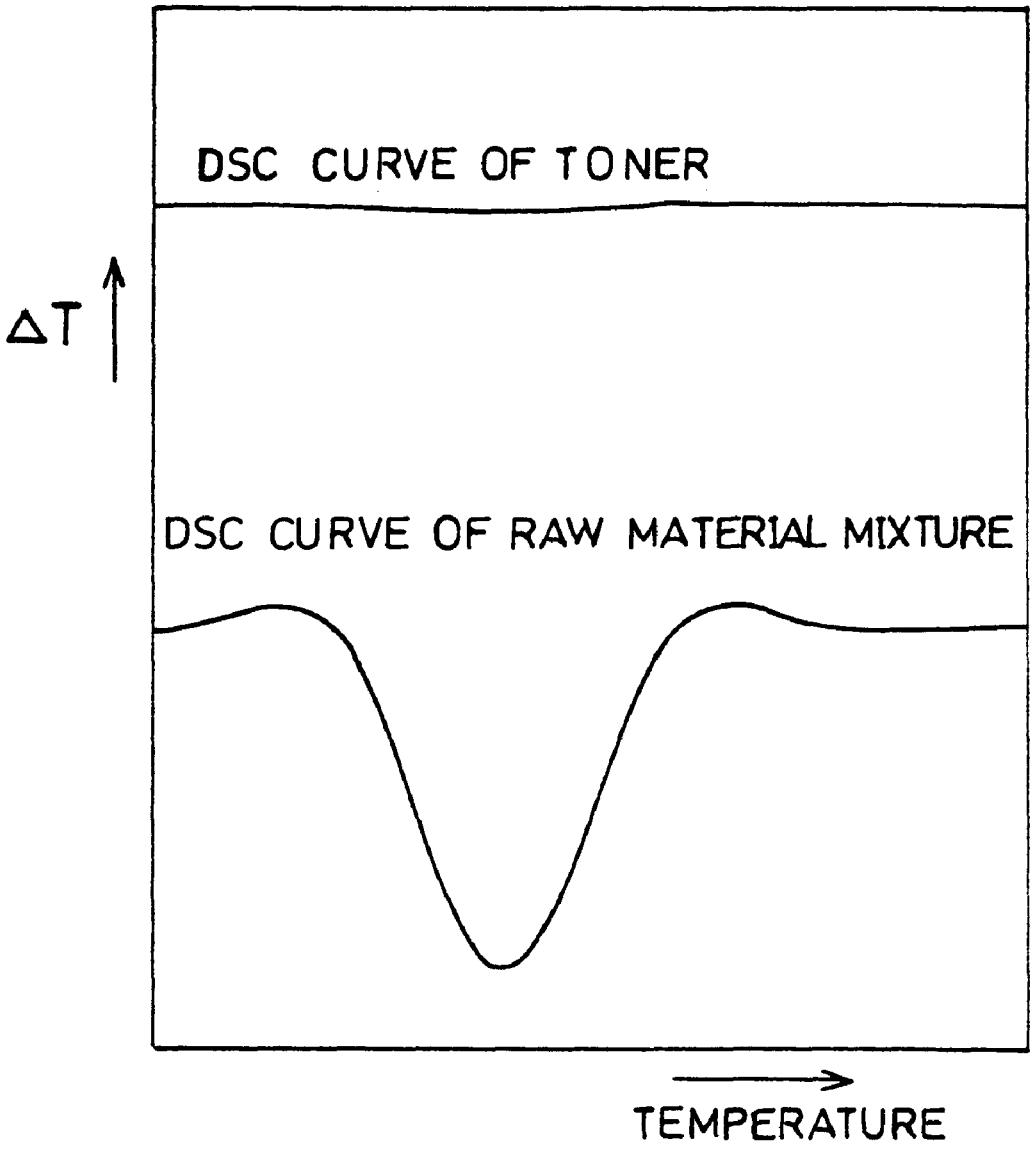
FIG. 7 is a chart of the differential scanning calorimetry of a raw material mixture and comparative toner obtained as another comparative example of the present invention.

Like Example 1, the raw material mixture and the toner were analyzed by differential scanning calorimetry. FIG. 7 shows the chart of the differential scanning calorimetry (DSC curve). According to the results, the ratio of area A to area B (B/A) was 0. Accordingly, a comparative toner was prepared.

Next, a comparative developer was produced by following the same procedure as in Example 3. Copy tests were performed using the resultant developer. The results are shown in Table 3. It is clear from the results that scattering of toner was "o". However, the amount of charge was increased with an increase in the number of copies produced, and the image density was lowered with an increase in the number of copies produced, under both the normal atmosphere and high-temperature high-humidity atmosphere. Accordingly, the overall evaluation was "x" under both the working atmospheres.

[COMPARATIVE EXAMPLE 5]

The same operations as in Example 1 were performed, except that the temperature at the discharge port of the kneader was set at 70° C. In this case, excessive load was applied to the motor of the kneader at 70° C., and the value of a current exceeded the upper limit. As a result, the kneader was stopped. Consequently, no toner was obtained. In this case, the melt viscosity of the melt-kneaded mixture at 70° C. was 160,000 Pa.s.

TABLE 1

| | Normal Atmosphere | | | High temperature and high-humidity atmosphere | | |
|---|---|---|---|---|---|---|
| | Charge μ (C/g) | Image density | Fog | Charge μ (C/g) | Image density | Fog |
| Example 1 | | | | | | |
| Copy test | | | | | | |
| Beginning | 11.20 | 1.38 | 0.32 | 11.10 | 1.39 | 0.35 |
| Aft. 5000 copies | 12.30 | 1.37 | 0.30 | 12.10 | 1.38 | 0.35 |
| Aft. 10000 copies | 12.50 | 1.38 | 0.31 | 12.20 | 1.39 | 0.35 |
| Scattering of toner | | ○ | | | ○ | |
| Overall evaluation | | ○ | | | ○ | |
| Example 2 | | | | | | |
| Copy test | | | | | | |
| Beginning | 11.50 | 1.39 | 0.32 | 11.80 | 1.39 | 0.41 |
| Aft. 5000 copies | 11.90 | 1.39 | 0.34 | 12.00 | 1.38 | 0.40 |
| Aft. 10000 copies | 12.20 | 1.38 | 0.32 | 12.10 | 1.40 | 0.37 |
| Scattering of toner | | ○ | | | ○ | |
| Overall evaluation | | ○ | | | ○ | |
| Example 3 | | | | | | |
| Copy test | | | | | | |
| Beginning | 12.40 | 1.38 | 0.35 | 12.20 | 1.39 | 0.34 |
| Aft. 5000 copies | 12.30 | 1.39 | 0.36 | 12.10 | 1.39 | 0.33 |
| Aft. 10000 copies | 12.10 | 1.39 | 0.33 | 12.30 | 1.38 | 0.33 |
| Scattering of toner | | ○ | | | ○ | |
| Overall evaluation | | ○ | | | ○ | |

TABLE 2

| | Normal Atmosphere | | | High temperature and high-humidity atmosphere | | |
|---|---|---|---|---|---|---|
| | Charge μ (C/g) | Image density | Fog | Charge μ (C/g) | Image density | Fog |
| Example 4 | | | | | | |
| Copy test | | | | | | |
| Beginning | 12.50 | 1.38 | 0.34 | 12.20 | 1.38 | 0.31 |
| Aft. 5000 copies | 12.60 | 1.39 | 0.33 | 12.20 | 1.39 | 0.33 |
| Aft. 10000 copies | 12.30 | 1.37 | 0.34 | 12.30 | 1.37 | 0.34 |
| Scattering of toner | | ○ | | | ○ | |
| Overall evaluation | | ○ | | | ○ | |
| Example 5 | | | | | | |
| Copy test | | | | | | |
| Beginning | 11.10 | 1.39 | 0.36 | 11.10 | 1.37 | 0.30 |
| Aft. 5000 copies | 11.90 | 1.38 | 0.35 | 12.10 | 1.39 | 0.29 |
| Aft. 10000 copies | 12.20 | 1.39 | 0.32 | 12.30 | 1.39 | 0.33 |
| Scattering of toner | | x | | | x | |
| Overall evaluation | | Δ | | | Δ | |
| Comparative Example 1 | | | | | | |
| Copy test | | | | | | |
| Beginning | 10.10 | 1.41 | 1.20 | 9.20 | 1.40 | 1.38 |
| Aft. 5000 copies | 9.20 | 1.41 | 1.25 | 7.30 | 1.41 | 1.44 |
| Aft. 10000 copies | 8.10 | 1.42 | 1.48 | 6.10 | 1.40 | 1.72 |
| Scattering of toner | | x | | | x | |
| Overall evaluation | | x | | | x | |

TABLE 3

| | Normal Atmosphere | | | High temperature and high-humidity atmosphere | | |
|---|---|---|---|---|---|---|
| | Charge μ (C/g) | Image density | Fog | Charge μ (C/g) | Image density | Fog |
| Comparative Example 2 | | | | | | |
| Copy test | | | | | | |
| Beginning | 11.30 | 1.39 | 0.55 | 10.10 | 1.40 | 1.45 |
| Aft. 5000 copies | 10.20 | 1.38 | 0.56 | 8.70 | 1.41 | 1.68 |
| Aft. 10000 copies | 10.10 | 1.40 | 0.58 | 7.50 | 1.41 | 1.93 |
| Scattering of toner | | x | | | x | |
| Overall evaluation | | Δ | | | x | |
| Comparative Example 3 | | | | | | |
| Copy test | | | | | | |
| Beginning | 12.80 | 1.35 | 0.22 | 11.50 | 1.37 | 0.44 |
| Aft. 5000 | 13.50 | 1.22 | 0.29 | 12.30 | 1.38 | 0.41 |

TABLE 3-continued

| | Normal Atmosphere | | | High temperature and high-humidity atmosphere | | |
|---|---|---|---|---|---|---|
| | Charge μ (C/g) | Image density | Fog | Charge μ (C/g) | Image density | Fog |
| copies | | | | | | |
| Aft. 10000 copies | 15.60 | 1.33 | 0.26 | 12.60 | 1.36 | 0.39 |
| Scattering of toner | | ○ | | | ○ | |
| Overall evaluation | | x | | | Δ | |
| Comparative Example 4 | | | | | | |
| Copy test | | | | | | |
| Beginning | 12.40 | 1.34 | 0.32 | 12.20 | 1.34 | 0.37 |
| Aft. 5000 copies | 13.40 | 1.23 | 0.33 | 13.50 | 1.31 | 0.34 |
| Aft. 10000 copies | 15.60 | 1.11 | 0.31 | 13.80 | 1.25 | 0.33 |
| Scattering of toner | | ○ | | | ○ | |
| Overall evaluation | | x | | | x | |

Referring now to Examples 6 to 14, and Comparative Examples 6 to 14, the following description will explain the absorbance of the quaternary ammonium salt compound at the absorption maximum wavelength of ultraviolet light.

[EXAMPLE 6]

A raw material mixture was prepared by placing and mixing 100 parts of styrene-acrylic acid copolymer (Sanyo Chemical Industries, Ltd.), 2 parts of polyethylene "PE-130" (Hoechst Ltd.) and 2 parts of polypropylene "Viscol 550P" (Sanyo Chemical Industries, Ltd.) as binder resins, 5 parts of carbon "MA-100S" (Mitsubishi Chemical Corporation) as a colorant, and 2 parts of a compound a (with a melting point of 188° C.) as a quaternary ammonium salt compound, in the Super Mixer (Kawata Manufacturing Co., Ltd.) as a mixer.

Subsequently, the raw material mixture was placed in the twin-screw kneader "PCM65" (Ikegai Corporation) as a kneading device. Then, the melt-kneading temperature of the kneader was set so that the temperature of the melt-kneaded raw material mixture, i.e., the melt-kneaded mixture, was 185° C. (when measured with a thermometer), and the temperature at the discharge port of the kneader was set at 160° C.

Thus, the difference between the melting point of the compound a and the melt-kneading temperature (|melt-kneading temperature−melting point|) was 3° C. The raw material mixture was melt-kneaded (twin-screw kneaded) under the following conditions until an evenly-mixed melt-kneaded mixture was obtained.

Thereafter, the melt-kneaded mixture was removed from the kneader, rolled out to a thickness of 1.5 mm with the rolling mill "Drum Flaker" (Mitsui Mining Co., Ltd), and then cooled down. The melt viscosity of the melt-kneaded mixture at the discharge port, the melt viscosity of the melt-kneaded mixture at 160° C., was 40,000 Pa.s. Next, the resultant rolled mixture (kneaded mixture) was ground and classified to provide a toner with an average particle diameter of 10 μm.

The toner was analyzed by spectroscopic analysis. As a result, the absorbance was 0.3. Accordingly, the toner of the present invention was obtained.

Next, 100 parts of the toner, and 0.1 part of silica powder "R972" (Nippon Aerosil Co., Ltd.), 0.1 part of magnetite powder "KBC100" (Kanto Denka Kogyo Co., Ltd.) and 0.1 part of hydrosulphite powder "ALCA-4" (Kyowa Chemical Industry Co., Ltd.) as external additives were placed and mixed in the mixer so as to prepare a toner composition. Moreover, 4 parts of the toner composition, and 100 parts of ferrite carrier produced by coating a ferrite core material with a silicon resin were placed in the Nautamixer (from Hosokawa Micron Corporation) as a mixer. Then, the toner composition and ferrite carrier were mixed by agitation so as to produce a developer of the present invention.

By leaving the toner composition in a bath with a controlled temperature of 50° C. for 48 hours, a toner composition left under the high-temperature atmosphere for a long time (hereinafter referred to as the "high-temperature-exposed toner") was prepared.

Copy tests were performed using the resultant developer and high-temperature-exposed toner. More specifically, the copy test was started using the developer, and the high-temperature-exposed toner was used as supply toner. The results are shown in Table 4. It is clear from the results that, even after the toner was left under the high-temperature atmosphere for a long time, the amount of the toner was stably retained in the appropriate range, the image density was stably high, and fog did not substantially occur. Besides, scattering of toner was "o". Accordingly, the overall evaluation was "o".

[EXAMPLE 7]

A toner with an average particle diameter of 10 μm was prepared by following the same procedure as in Example 6, except that the melt-kneading temperature of the twin-screw kneader was set so that the temperature of the melt-kneaded mixture was 192° C. (when measured by a contact thermometer), the temperature at the discharge port of the kneader was set at 170° C., and the melt-kneaded mixture was rolled out to a thickness of 2.8 mm. The difference between the melting point of the compound a and the melt-kneading temperature was 4° C. The melt viscosity of the melt-kneaded mixture at 170° C. was 23,500 Pa.s.

The toner was analyzed by spectroscopic analysis in the same manner as in Example 6. As a result, the absorbance was 0.2. Accordingly, the toner of the present invention was obtained.

Next, a toner composition was produced by following the same procedure as in Example 6. Then, 4 parts of the toner composition and 100 parts of iron carrier (with an average particle diameter of 100 μm) produced by coating an iron core material (iron powder) with a fluoroplastic were placed in the Nautamixer (from Hosokawa Micron Corporation) as a mixer. The toner composition and iron carrier were mixed by agitation so as to produce a developer of the present invention. Moreover, a high-temperature-exposed toner was prepared in the same manner as in Example 6.

Copy tests were performed using the resultant developer and high-temperature-exposed toner. The results are shown in Table 4. It can be understood from the results that, even after the toner was left under the high-temperature atmosphere for a long time, the amount of charge was stably retained in the appropriate range, the image density and toner concentration were kept stably high, and fog did not substantially occur. Besides, scattering of toner was "o". Accordingly, the overall evaluation was "o".

[EXAMPLE 8]

A toner with an average particle diameter of 10 μm was prepared by following the same procedure as in Example 6, except that 2 parts of the compound b (with a melting point of 195° C.) was used as a quaternary ammonium salt compound instead of the compound a, the melt-kneading temperature of the twin-screw kneader was set so that the temperature of the melt-kneaded mixture was 190° C. (when measured by a contact thermometer), the temperature at the discharge port of the kneader was set at 165° C., and the melt-kneaded mixture was rolled out to a thickness of 2.3 mm. The difference between the melting point of the compound b and the melt-kneading temperature was 5° C. The melt viscosity of the melt-kneaded mixture at 165° C. was 27,000 Pa.s.

The toner was analyzed by spectroscopic analysis in the same manner as in Example 6. As a result, the absorbance was 0.4. Accordingly, the toner of the present invention was obtained. The absorption maximum wavelength appeared in the vicinity of 287 nm.

Next, a toner composition, and developer of the present invention were produced by following the same procedure as in Example 6. Moreover, a high-temperature-exposed toner was prepared in the same manner as in Example 6.

Copy tests were performed using the resultant developer and high-temperature-exposed toner. The results are shown in Table 4. It can be understood from the results that, even after the toner was left under the high-temperature atmosphere for a long time, the amount of charge was retained in the appropriate range, the image density and the toner concentration were kept stably high, and fog did not substantially occur. Besides, scattering of toner was "o". Accordingly, the overall evaluation was "o".

[EXAMPLE 9]

A toner with an average particle diameter of 10 $\mu$m was prepared by following the same procedure as in Example 6, except that 2 parts of the compound b (with a melting point of 195° C.) was used instead of the compound a, the melt-kneading temperature of the twin-screw kneader was set so that the temperature of the melt-kneaded mixture was 197° C. (when measured by a contact thermometer), the temperature at the discharge port of the kneader was set at 180° C., and the melt-kneaded mixture was rolled out to a thickness of 2.0 mm. The difference between the melting point of the compound b and the melt-kneading temperature was 2° C. The melt viscosity of the melt-kneaded mixture at 180° C. was 15,200 Pa.s.

The toner was analyzed by spectroscopic analysis in the same manner as in Example 6. As a result, the absorbance was 0.25. Accordingly, the toner of the present invention was obtained. The absorption maximum wavelength appeared in the vicinity of 287 nm.

Next, a toner composition and a developer of the present invention were produced by following the same procedure as in Example 7. Moreover, high-temperature-exposed toner was prepared in the same manner as in Example 6.

Copy tests were performed using the resultant developer and high-temperature-exposed toner. It can be understood from the results that, even after the toner was left under the high-temperature atmosphere for a long time, the amount of charge was retained stably in the appropriate range, the image density and the toner concentration were kept stably high, and fog did not substantially occur. Besides, scattering of toner was "o". Accordingly, the overall evaluation was "o".

[EXAMPLE 10]

A toner composition and a developer were produced by following the same procedure as in Example 6. Moreover, by leaving the developer in a bath with a temperature controlled at 50° C. for 48 hours, a developer left under the high-temperature atmosphere for a long time (hereinafter referred to as the "high-temperature-exposed developer") was prepared.

Copy tests were performed using the resultant high-temperature-exposed developer and the toner composition. More specifically, the copy test was started using the developer, and the toner composition was used as supply toner. The results are shown in Table 5. It can be understood from the results that, even after the developer was left under the high-temperature atmosphere for a long time, the amount of charge was retained stably in the appropriate range, the image density and the toner concentration were kept stably high, and fog did not substantially occur. Besides, scattering of toner was "o". Accordingly, the overall evaluation was "o".

[EXAMPLE 11]

A toner composition and a developer were produced by following the same procedure as in Example 7. Moreover, a high-temperature-exposed developer was prepared by following the same procedure as in Example 10.

Copy tests were performed using the resultant high-temperature-exposed developer and the toner composition. The results are shown in Table 5. It can be understood from the results that, even after the developer was left under the high-temperature atmosphere for a long time, the amount of charge was retained stably in the appropriate range, the image density and the toner concentration were kept stably high, and fog did not substantially occur. Besides, scattering of toner was "o". Accordingly, the overall evaluation was "o".

[EXAMPLE 12]

A toner composition and a developer were produced by following the same procedure as in Example 8. Moreover, a high-temperature-exposed developer was prepared by following the same procedure as in Example 10.

Copy tests were performed using the resultant high-temperature-exposed developer and the toner composition. The results are shown in Table 5. It can be understood from the results that, even after the developer was left under the high-temperature atmosphere for a long time, the amount of charge was retained stably in the appropriate range, the image density and the toner concentration were kept stably high, and fog did not substantially occur. Besides, scattering of toner was "o". Accordingly, the overall evaluation was "o".

[EXAMPLE 13]

A toner composition and a developer were produced by following the same procedure as in Example 9. Moreover, a high-temperature-exposed developer was prepared by following the same procedure as in Example 10.

Copy tests were performed using the resultant high-temperature-exposed developer and the toner composition. The results are shown in Table 5. It can be understood from the results that, even after the developer was left under the high-temperature atmosphere for a long time, the amount of charge was retained stably in the appropriate range, the image density and the toner concentration were kept stably high, and fog did not substantially occur. Besides, scattering of toner was "o". Accordingly, the overall evaluation was "o".

[EXAMPLE 14]

A toner with an average particle diameter of 10 μm was prepared by following the same procedure as in Example 6, except that the melt-kneading temperature of the twin-screw kneader was set so that the temperature of the melt-kneaded mixture was 195° C. (when measured by a contact thermometer). The difference between the melting point of the compound a and the melt-kneading temperature was 7° C.

The toner was analyzed by spectroscopic analysis in the same manner as in Example 6. As a result, the absorbance was 0.25. Accordingly, the toner of the present invention was obtained.

Next, a developer of the present invention and a high-temperature-exposed toner were produced by following the same procedure as in Example 6. Copy tests were performed using the resultant developer and high-temperature-exposed toner. The results are shown in Table 6. It can be understood from the results that the amount of charge was slightly decreased on the whole, and the degree of fog was slightly increased on the whole. However, substantially no problem occurred. In this case, scattering of toner was "Δ". Accordingly, the overall evaluation was "Δ".

[COMPARATIVE EXAMPLE 6]

A toner with an average particle diameter of 10 μm was prepared in the same manner as in Example 6, except that the melt-kneading temperature of the twin-screw kneader was set so that the temperature of the melt-kneaded mixture was 178° C. (when measured by a contact thermometer). The difference between the melting point of the compound a and the melt-kneading temperature was 10° C. Therefore, the melt-kneading temperature was out of the above-mentioned range.

The toner was analyzed by spectroscopic analysis in the same manner as in Example 6. As a result, the absorbance was 0.5. Accordingly, a comparative toner was prepared.

Next, a comparative developer and a comparative high-temperature-exposed toner were produced by following the same procedure as in Example 6. Copy tests were performed using the resultant comparative developer and comparative high-temperature-exposed toner. The results are shown in Table 6. It can be understood from the results that the amount of charge was decreased with an increase in the number of copies produced, and the degree of fog was increased on the whole. Besides, scattering of toner was "Δ". Accordingly, the overall evaluation was "x".

[COMPARATIVE EXAMPLE 7]

A toner with an average particle diameter of 10 μm was prepared in the same manner as in Example 7, except that the thickness of the melt-kneaded mixture was rolled out to a thickness of 1.0 mm. Therefore, the thickness of the melt-kneaded mixture was out of the above-mentioned range.

The toner was analyzed by spectroscopic analysis in the same manner as in Example 6. As a result, the absorbance was 0.18. Accordingly, a comparative toner was prepared.

Next, a comparative developer and a comparative high-temperature-exposed toner were produced by following the same procedure as in Example 7. Copy tests were performed using the resultant comparative developer and comparative high-temperature-exposed toner. The results are shown in Table 6. It can be understood from the results that the amount of charge was decreased significantly on the whole, and the degree of fog was increased significantly on the whole. Besides, scattering of toner was "x", and the copy test could not be continued without occasionally cleaning the inside of the copying machine. Accordingly, the overall evaluation was "x".

[COMPARATIVE EXAMPLE 8]

A toner with an average particle diameter of 10 μm was prepared in the same manner as in Example 7, except that the thickness of the melt-kneaded mixture was rolled out to a thickness of 3.5 mm. Therefore, the thickness of the melt-kneaded mixture was out of the above-mentioned range.

The toner was analyzed by spectroscopic analysis in the same manner as in Example 6. As a result, the absorbance was 0.43. Accordingly, a comparative toner was prepared.

Next, a comparative developer and a comparative high-temperature-exposed toner were produced by following the same procedure as in Example 7. Copy tests were performed using the resultant comparative developer and comparative high-temperature-exposed toner. The results are shown in Table 6. It can be understood from the results that the amount of charge was decreased with an increase in the number of copies produced, and the degree of fog becomes higher with an increase in the number of copies produced. Besides, scattering of toner was "Δ". In this case, although the image quality was not lowered, the inside of the copying machine was made slightly dirty. Accordingly, the overall evaluation was "x".

[COMPARATIVE EXAMPLE 9]

A toner with an average particle diameter of 10 μm was prepared in the same manner as in Example 8, except that the temperature at the discharge port of the kneader was set at 200° C. The melt viscosity of the melt-kneaded mixture at the discharge port of the kneader, i.e., the melt viscosity of the melt-kneaded mixture at 200° C., was 8,900 Pa.s. Therefore, the temperature at the discharge port was out of the above-mentioned range.

The toner was analyzed by spectroscopic analysis in the same manner as in Example 6. As a result, the absorbance was 0.32. Accordingly, a comparative toner was prepared.

Next, a comparative developer and a comparative high-temperature-exposed toner were produced by following the same procedure as in Example 8. Copy tests were performed using the resultant comparative developer and comparative high-temperature-exposed toner. The results are shown in Table 7. It can be understood from the results that the amount of charge was decreased on the whole, and the degree of fog was increased on the whole. Besides, scattering of toner was "Δ". In this case, although the image quality was not lowered, the inside of the copying machine was made slightly dirty. Accordingly, the overall evaluation was "Δ".

[COMPARATIVE EXAMPLE 10]

A toner composition was prepared by following the same procedure as in Example 6. Moreover, a comparative developer was produced by the same procedure as in Comparative Example 6. Furthermore, a comparative high-temperature-exposed developer was prepared by applying the same treatment as in Example 10.

Copy tests were performed using the resultant comparative high-temperature-exposed developer and toner composition. More specifically, the copy test was started using the comparative high-temperature-exposed developer, and the toner composition was used as supply toner. The results are shown in Table 7. It can be understood from the results that scattering of toner was "o". However, the toner concentration was much lower than a specified value (3.8%), and therefore the image density was decreased on the whole. Accordingly, the overall evaluation was "x".

[COMPARATIVE EXAMPLE 11]

A toner composition was prepared by following the same procedure as in Example 7. Moreover, a comparative developer was produced by the same procedure as in Comparative Example 14. Furthermore, a comparative high-temperature-exposed developer was prepared by applying the same treatment as in Example 10.

Copy tests were performed using the resultant comparative high-temperature-exposed developer and toner composition. The results are shown in Table 7. It can be understood from the results that scattering of toner was "o". However, the toner concentration was much lower than the specified value. Therefore, the image density was decreased on the whole, and image defects occur partially. Accordingly, the overall evaluation was "x".

[COMPARATIVE EXAMPLE 12]

A toner composition was prepared by following the same procedure as in Example 8. Moreover, a comparative developer was produced by the same operations as in Comparative Example 7. Furthermore, a comparative high-temperature-exposed developer was prepared by applying the same treatment as in Example 10.

An attempt to perform copy tests using the resultant comparative high-temperature-exposed developer and toner composition was made. However, copying could not be started. More specifically, a copying machine used in the copy tests was provided with a toner control sensor for detecting the amount of charge and toner concentration in the developer. The sensor judged that the amount of charge and toner concentration in the comparative high-temperature-exposed developer were out of the specified range (level). Therefore, copying was not started. According to the results of a measurement, the amount of charge of the comparative developer was 1.23 C/g, and that of the comparative high-temperature-exposed developer was 2.38 C/g. It was thus found that, after leaving the developer under the high-temperature atmosphere for a long time, the amount of charge was significantly lowered.

[COMPARATIVE EXAMPLE 13]

A toner composition was prepared by following the same procedure as in Example 9. Moreover, a comparative developer was produced by the same procedure as in Comparative Example 8. Furthermore, a comparative high-temperature-exposed developer was prepared by applying the same treatment as in Example 10.

Copy tests were executed using the resultant comparative high-temperature-exposed developer and toner composition. The results are shown in FIG. 7. It can be understood from the results that scattering of toner was "o". However, the toner concentration was much lower than the specified value, and therefore the image density was decreased on the whole. Accordingly, the overall evaluation was "x".

[COMPARATIVE EXAMPLE 14]

The same operations as in Example 6 were performed, except that the temperature at the discharge port of the kneader was set at 70° C. However, at 70° C., excessive load was applied to the motor of the kneader, and the value of the current exceeded the upper limit. As a result, the kneader was stopped. Consequently, no toner was obtained. In this case, the melt viscosity of the melt-kneaded mixture at 70° C. was 160,000 Pa.s.

TABLE 4

| | Charge $\mu$ (C/g) | Image density | Fog | Toner concentration (%) | Scattering of toner | Overall evaluation |
|---|---|---|---|---|---|---|
| Example 6 | | | | | | |
| Copy test | | | | | | |
| Beginning | 11.20 | 1.38 | 0.35 | 3.7 | ○ | ○ |
| After 5000 copies | 11.40 | 1.39 | 0.36 | 3.8 | | |
| After 10000 copies | 11.60 | 1.38 | 0.34 | 3.8 | | |
| Example 7 | | | | | | |
| Copy test | | | | | | |
| Beginning | 10.90 | 1.39 | 0.31 | 3.7 | ○ | ○ |
| After 5000 copies | 11.10 | 1.38 | 0.30 | 3.6 | | |
| After 10000 copies | 11.20 | 1.38 | 0.33 | 3.8 | | |
| Example 8 | | | | | | |
| Copy test | | | | | | |
| Beginning | 10.80 | 1.37 | 0.35 | 3.7 | ○ | ○ |
| After 5000 copies | 10.90 | 1.37 | 0.36 | 3.6 | | |
| After 10000 copies | 10.80 | 1.38 | 0.34 | 3.6 | | |

TABLE 4-continued

| | Charge μ (C/g) | Image density | Fog | Toner concentration (%) | Scattering of toner | Overall evaluation |
|---|---|---|---|---|---|---|
| Example 9 | | | | | | |
| Copy test | | | | | | |
| Beginning | 11.20 | 1.38 | 0.38 | 3.6 | ○ | ○ |
| After 5000 copies | 12.30 | 1.38 | 0.39 | 3.9 | | |
| After 10000 copies | 12.50 | 1.39 | 0.37 | 3.9 | | |

TABLE 5

| | Charge μ (C/g) | Image density | Fog | Toner concentration (%) | Scattering of toner | Overall evaluation |
|---|---|---|---|---|---|---|
| Example 10 | | | | | | |
| Copy test | | | | | | |
| Beginning | 11.50 | 1.37 | 0.29 | 3.7 | ○ | ○ |
| After 5000 copies | 11.30 | 1.38 | 0.31 | 3.7 | | |
| After 10000 copies | 11.70 | 1.37 | 0.28 | 3.6 | | |
| Example 11 | | | | | | |
| Copy test | | | | | | |
| Beginning | 10.90 | 1.39 | 0.41 | 3.8 | ○ | ○ |
| After 5000 copies | 11.10 | 1.39 | 0.35 | 3.7 | | |
| After 10000 copies | 11.60 | 1.38 | 0.38 | 3.7 | | |
| Example 12 | | | | | | |
| Copy test | | | | | | |
| Beginning | 10.90 | 1.38 | 0.39 | 3.8 | ○ | ○ |
| After 5000 copies | 10.80 | 1.38 | 0.39 | 3.8 | | |
| After 10000 copies | 11.10 | 1.37 | 0.41 | 3.6 | | |
| Example 13 | | | | | | |
| Copy test | | | | | | |
| Beginning | 11.20 | 1.37 | 0.41 | 3.6 | ○ | ○ |
| After 5000 copies | 11.10 | 1.38 | 0.39 | 3.7 | | |
| After 10000 copies | 11.60 | 1.36 | 0.34 | 3.6 | | |

TABLE 6

| | Charge μ (C/g) | Image density | Fog | Toner concentration (%) | Scattering of toner | Overall evaluation |
|---|---|---|---|---|---|---|
| Example 14 | | | | | | |
| Copy test | | | | | | |
| Beginning | 10.90 | 1.40 | 1.10 | 3.8 | Δ | Δ |
| After 5000 copies | 10.70 | 1.39 | 1.09 | 3.9 | | |
| After 10000 copies | 10.10 | 1.39 | 1.12 | 4.0 | | |

TABLE 6-continued

| | Charge μ (C/g) | Image density | Fog | Toner concentration (%) | Scattering of toner | Overall evaluation |
|---|---|---|---|---|---|---|
| Comparative Example 6 | | | | | | |
| Copy test | | | | | | |
| Beginning | 10.50 | 1.40 | 1.25 | 3.7 | Δ | x |
| After 5000 copies | 10.10 | 1.41 | 1.33 | 3.9 | | |
| After 10000 copies | 9.10 | 1.39 | 1.39 | 4.2 | | |
| Comparative Example 7 | | | | | | |
| Copy test | | | | | | |
| Beginning | 8.70 | 1.41 | 2.65 | 3.8 | x | x |
| After 5000 copies | 7.50 | 1.42 | 3.35 | 4.1 | | |
| After 10000 copies | 7.10 | 1.42 | 3.32 | 4.6 | | |
| Comparative Example 8 | | | | | | |
| Copy test | | | | | | |
| Beginning | 10.10 | 1.39 | 0.92 | 3.9 | Δ | x |
| After 5000 copies | 9.40 | 1.39 | 1.13 | 4.2 | | |
| After 10000 copies | 8.20 | 1.40 | 1.45 | 4.3 | | |

TABLE 7

| | Charge μ (C/g) | Image density | Fog | Toner concentration (%) | Scattering of toner | Overall evaluation |
|---|---|---|---|---|---|---|
| Comparative Example 9 | | | | | | |
| Copy test | | | | | | |
| Beginning | 9.80 | 1.38 | 1.10 | 3.8 | Δ | Δ |
| After 5000 copies | 8.50 | 1.39 | 1.12 | 3.9 | | |
| After 10000 copies | 8.20 | 1.40 | 1.39 | 4.1 | | |
| Comparative Example 10 | | | | | | |
| Copy test | | | | | | |
| Beginning | 12.30 | 1.31 | 0.35 | 3.5 | ○ | x |
| After 5000 copies | 13.10 | 1.29 | 0.38 | 2.8 | | |
| After 10000 copies | 13.50 | 1.23 | 0.33 | 2.4 | | |
| Comparative Example 11 | | | | | | |
| Copy test | | | | | | |
| Beginning | 12.60 | 1.29 | 0.26 | 3.5 | ○ | x |
| After 5000 copies | 13.40 | 1.27 | 0.28 | 3.1 | | |
| After 10000 copies | 13.20 | 1.21 | 0.31 | 3.2 | | |

TABLE 7-continued

| | Charge $\mu$ (C/g) | Image density | Fog | Toner concentration (%) | Scattering of toner | Overall evaluation |
|---|---|---|---|---|---|---|
| Comparative Example 12 | | | | | | |
| Copy test | | | | | | |
| Beginning | 12.60 | 1.24 | 0.36 | 3.5 | ○ | x |
| After 5000 copies | 13.30 | 1.25 | 0.32 | 3.0 | | |
| After 10000 copies | 13.90 | 1.22 | 0.39 | 2.9 | | |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for producing a toner by kneading a raw material mixture containing a quaternary ammonium salt compound, comprising the steps of:

melt-kneading said raw material mixture at a temperature ranging from (M−7)° C. to (M+7)° C., where M is a melting point of said quaternary ammonium salt compound, using a kneading device having a discharge port whose temperature is set lower than a temperature at which a melt viscosity of a melt-kneaded mixture at the discharge port is not higher than 10,000 Pa.a, said melt-kneaded mixture being formed by the melt-kneading of said raw material mixture;

removing said melt-kneaded mixture from said kneading device;

rolling out said melt-kneaded mixture to a thickness ranging from 1.2 mm to 3.0 mm; and cooling down said melt-kneaded mixture.

2. A toner comprising a composition, said composition being formed by melt-kneading a raw material mixture containing a quaternary ammonium salt compound at a temperature ranging from (M−7)° C. to (M+7)° C., where M is a melting point of said quaternary ammonium salt compound, with a kneading device having a discharge port whose temperature is set lower than a temperature at which a melt viscosity of a melt-kneaded mixture at the discharge port is not higher than 10,000 Pa.a, rolling out said melt-kneaded mixture to a thickness ranging from 1.2 mm to 3.0 mm, and cooling down said melt-kneaded mixture, said melt-kneaded mixture being formed by the melt-kneading of said raw material mixture.

3. The toner as set forth in claim 2, wherein said toner satisfies inequality (I)

$$(B/A)<0.2 \quad \text{(I)}$$

where A is a peak area of a thermal analysis absorption peak of said quaternary ammonium salt compound per unit weight of said raw material mixture, and B is a peak area of a thermal analysis absorption peak of said quaternary ammonium salt compound per unit weight of said toner produced from said raw material mixture, under same conditions.

4. The toner as set forth in claim 2, wherein said quaternary ammonium salt compound has an absorbance ranging from 0.2 to 0.4 at an absorption maximum wavelength of ultraviolet light when a supernatant of a solution prepared by dissolving 100 mg of said toner in a 50 ml of a solvent is measured using a cell with a length of 1 cm by a predetermined method.

5. The toner as set forth in claim 2, wherein said quaternary ammonium salt compound is a compound represented by general formula (1)

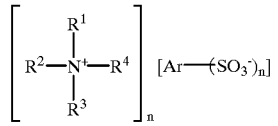

(1)

where $R^1$, $R^2$, $R^3$ and $R^4$ independently represent an alkyl group with or without a substituent, or an aralkyl group with or without a substituent, Ar is an aromatic ring residue with or without a substituent, and n is a natural number.

6. The toner as set forth in claim 2, wherein said raw material mixture comprises at least one kind of binder resin selected from the group consisting of styrene resins, saturated polyester resins, and unsaturated polyester resins.

7. The toner as set forth in claim 2, wherein said raw material mixture comprises at least one kind of charge control agent, such as a nigrosine compound, a polyamine compound resin, a triamino triphenyl methane compound, an imidazole compound, and a styrene-amino acrylate copolymer, in addition to said quaternary ammonium salt compound.

8. The toner as set forth in claim 6, wherein said quaternary ammonium salt compound is used in an amount ranging from 0.05 part to 10 parts by weight based on 100 parts by weight of said binder resin.

9. The toner as set forth in claim 6, further comprising an assistant, an external additive, and a mold releasing agent.

10. The toner as set forth in claim 9, wherein at least one kind of an additive selected from polyalkylene wax, paraffin wax, higher fatty acid, fatty amide, and metallic soap is used as the assistant.

11. The toner as set forth in claim 9, wherein said assistant is used in an amount ranging from 0.1 part to 10 parts by weight based on 100 parts by weight of said binder resin.

12. The toner as set forth in claim 9, wherein at least either of fine particles of a metal oxide and fine particles of a synthetic resin is used as said external additive.

13. The toner as set forth in claim 9, wherein said external additive is used in an amount ranging from 0.01 part to 5 parts by weight based on 100 parts by weight of said binder resin.

14. The toner as set forth in claim 9, wherein at least either of polyethylene and polypropylene is used as said mold releasing agent.

15. A developer comprising the toner set forth in claim 2, and carrier.

16. The developer as set forth in claim 15, wherein said carrier is formed by coating a ferrite core material or an iron core material with a silicon resin or a fluoroplastic.

* * * * *